US010281157B2

(12) United States Patent
Best et al.

(10) Patent No.: US 10,281,157 B2
(45) Date of Patent: May 7, 2019

(54) GAS COOKTOP WITH INTEGRATED WOK

(71) Applicant: Wolf Appliance, Inc., Fitchburg, WI (US)

(72) Inventors: Patrick W. Best, Mount Horeb, WI (US); Aaron Hotz, Middleton, WI (US); Nicholas H. Schutte, Verona, WI (US); Jared W. Wells, Madison, WI (US)

(73) Assignee: WOLF APPLIANCE, INC., Fitchburg, WI (US)

( * ) Notice: Subject to any disclaimer, the term of this patent is extended or adjusted under 35 U.S.C. 154(b) by 706 days.

(21) Appl. No.: 15/040,736

(22) Filed: Feb. 10, 2016

(65) Prior Publication Data

US 2017/0227235 A1 Aug. 10, 2017

(51) Int. Cl.
*F24C 15/10* (2006.01)
*F24C 3/08* (2006.01)

(52) U.S. Cl.
CPC ..... *F24C 15/10* (2013.01); *F24C 3/085* (2013.01)

(58) Field of Classification Search
CPC ..... F24C 3/085; F24C 15/10; F24C 3/047
See application file for complete search history.

(56) References Cited

U.S. PATENT DOCUMENTS 5,315,983 A * 5/1994 Law ..... F24C 15/10 126/214 D
5,431,146 A 7/1995 Humphrey
6,253,759 B1 7/2001 Giebel
D637,040 S 5/2011 King et al.
D641,197 S 7/2011 Borin
D648,597 S 11/2011 King et al.
8,246,705 B2 8/2012 Bain et al.
(Continued)

FOREIGN PATENT DOCUMENTS

AU 2013205958 12/2013
AU 2015213306 3/2016
(Continued)

OTHER PUBLICATIONS

25000 BTU LPG Stainless Steel Wok Stove with Cast Iron Burner, posted at Amazon.com, posted on Jun. 21, 2016, site visited Mar. 28, 2017, https://www.amazon.com/25000-Stain_less-Steel-Stove-Burner/dp/B01BHJY2ME.

(Continued)

*Primary Examiner* — Alfred Basichas
(74) *Attorney, Agent, or Firm* — Bell & Manning, LLC

(57) ABSTRACT

A chimney assembly includes a cone assembly and a chimney. The cone assembly includes a wall forming a truncated cone having an outer surface, a first circumferential edge, and a second circumferential edge, a support flange extending from the outer surface, and a bottom wall extending between the second circumferential edge and including a burner aperture wall formed therethrough. The chimney includes an inner wall, an outer wall circumscribing the inner wall, a bottom chimney wall, and a plurality of tabs. The bottom chimney wall extends between a first cylinder formed by the inner wall and a second cylinder formed by the outer wall. The plurality of tabs extend from the inner wall toward a center of the first cylinder. The support flange rests on the plurality of tabs.

20 Claims, 26 Drawing Sheets

(56) References Cited

U.S. PATENT DOCUMENTS

| | | | | |
|---|---|---|---|---|
| D751,855 | S | 3/2016 | Bassill et al. | |
| D771,437 | S | 11/2016 | Segers et al. | |
| D772,648 | S | 11/2016 | Palermo | |
| D773,236 | S | 12/2016 | Durant | |
| D775,888 | S | 1/2017 | Kim | |
| D781,637 | S | 3/2017 | Mercier | |
| D812,415 | S * | 3/2018 | Best | D7/362 |
| 2003/0121512 | A1* | 7/2003 | Luther | F24C 3/085 126/41 R |
| 2006/0108433 | A1 | 5/2006 | Fossati et al. | |
| 2009/0235922 | A1* | 9/2009 | Johnson | F24C 3/047 126/92 AC |
| 2010/0154770 | A1* | 6/2010 | Zhou | F24C 3/14 126/42 |
| 2014/0158680 | A1 | 6/2014 | Kitaizumi et al. | |
| 2014/0216439 | A1* | 8/2014 | Soohoo | F24C 3/085 126/39 B |
| 2014/0251980 | A1 | 9/2014 | Lin | |
| 2015/0090246 | A1 | 4/2015 | Gravel | |

FOREIGN PATENT DOCUMENTS

| | | | |
|---|---|---|---|
| CN | 2795702 | Y | 7/2006 |
| CN | 201000109 | Y | 1/2008 |
| CN | 101639235 | A | 2/2010 |
| CN | 103953953 | A | 7/2014 |
| CN | 204084478 | U | 1/2015 |
| CN | 104879812 | A | 9/2015 |
| DE | 202016000820 | | 4/2016 |
| EP | 2390569 | | 11/2011 |
| FR | 2853954 | B1 | 12/2006 |
| FR | 2928203 | | 9/2009 |
| GB | 2528577 | A | 1/2016 |

OTHER PUBLICATIONS

Companion Single Burner Wok Cooker Silver Single, posted at Anacondastores.com, posted on © 2017, site visited Mar. 28, 2017, <https://www.anacondastores.com/camping-hiking/camp-cooking/camping-stoves/companion-single-burner-wok-cooker/p/BP90028534>.

* cited by examiner

GAS COOKTOP WITH INTEGRATED WOK

BACKGROUND

A gas cooktop may include a wok ring instead of a burner cover to concentrate heat on a bottom of a wok positioned on the wok ring. A wok has a curved concave shape that produces a small, hot area at the bottom allowing some of the food to be seared by intense heat while using relatively little fuel. The sloped sides of the wok make it easier to use a toss cooking technique, concentrate bite-sized or finely chopped stir-fry ingredients into the center of the wok, and provide a larger usable cooking surface versus western-styled pots and pans, which typically have more vertical edges.

SUMMARY

In an example embodiment, a chimney assembly for a wok burner assembly for a gas cooktop is provided. The chimney assembly may include, but is not limited to, a cone assembly and a chimney. The cone assembly may include, but is not limited to, a wall, a support flange, and a bottom wall. The wall forms a truncated cone having an inner surface, an outer surface, a first circumferential edge, and a second circumferential edge. The truncated cone does not include a cone apex. The support flange extends from the outer surface of the wall. The bottom wall extends between the second circumferential edge of the wall. The bottom wall includes a burner aperture wall formed through the bottom wall. A length of the second circumferential edge is smaller than a length of the first circumferential edge. The chimney may include, but is not limited to, an inner wall, an outer wall, a bottom chimney wall, and a plurality of tabs. The inner wall forms a first cylinder and has a third circumferential edge and a fourth circumferential edge. The outer wall forms a second cylinder and has a fifth circumferential edge and a sixth circumferential edge. The outer wall circumscribes the inner wall. The inner wall and the outer wall are separated by an air gap. The bottom chimney wall extends between the third circumferential edge and the fifth circumferential edge. The plurality of tabs extend from the fourth circumferential edge toward a center of the first cylinder. The support flange rests on the plurality of tabs when the cone assembly is mounted within the inner wall of the chimney.

In another example embodiment, a wok burner assembly for a gas cooktop is provided. The wok burner assembly may include, but is not limited to, the chimney assembly, a wok burner mounted through the burner aperture wall, an outer support frame, a top plate, and a wok ring. The top plate may include, but is not limited to, a ring aperture wall formed through the top plate. The top plate is mounted on the outer support frame, which supports the top plate above the fourth circumferential edge of the inner wall. The wok ring is positioned adjacent the first circumferential edge of the wall within the ring aperture wall.

In yet another example embodiment, a gas cooktop is provided. The gas cooktop may include, but is not limited to, a housing comprising one or more walls, an input gas line, the chimney assembly, the wok burner, the outer support frame, the top plate, the wok ring, and a knob assembly. The knob assembly may include, but is not limited to, a valve configured to connect to the input gas line to receive gas, and a knob mounted to the valve to control a flow of the received gas from the valve to the wok burner when the knob is rotated.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
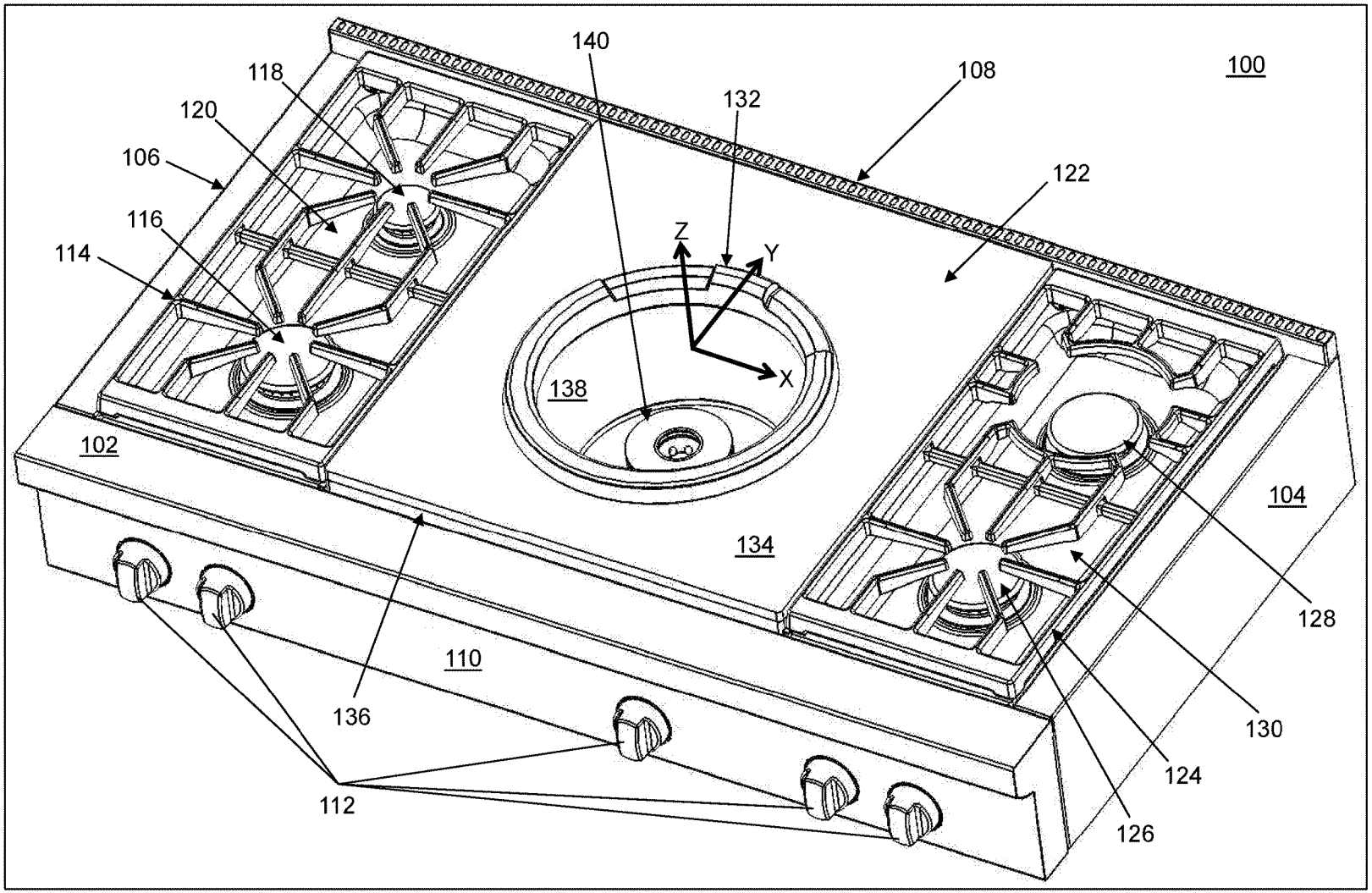
FIG. 1 depicts a top, front perspective view of a first cooktop with a wok burner assembly in accordance with an illustrative embodiment.
Figure 2:
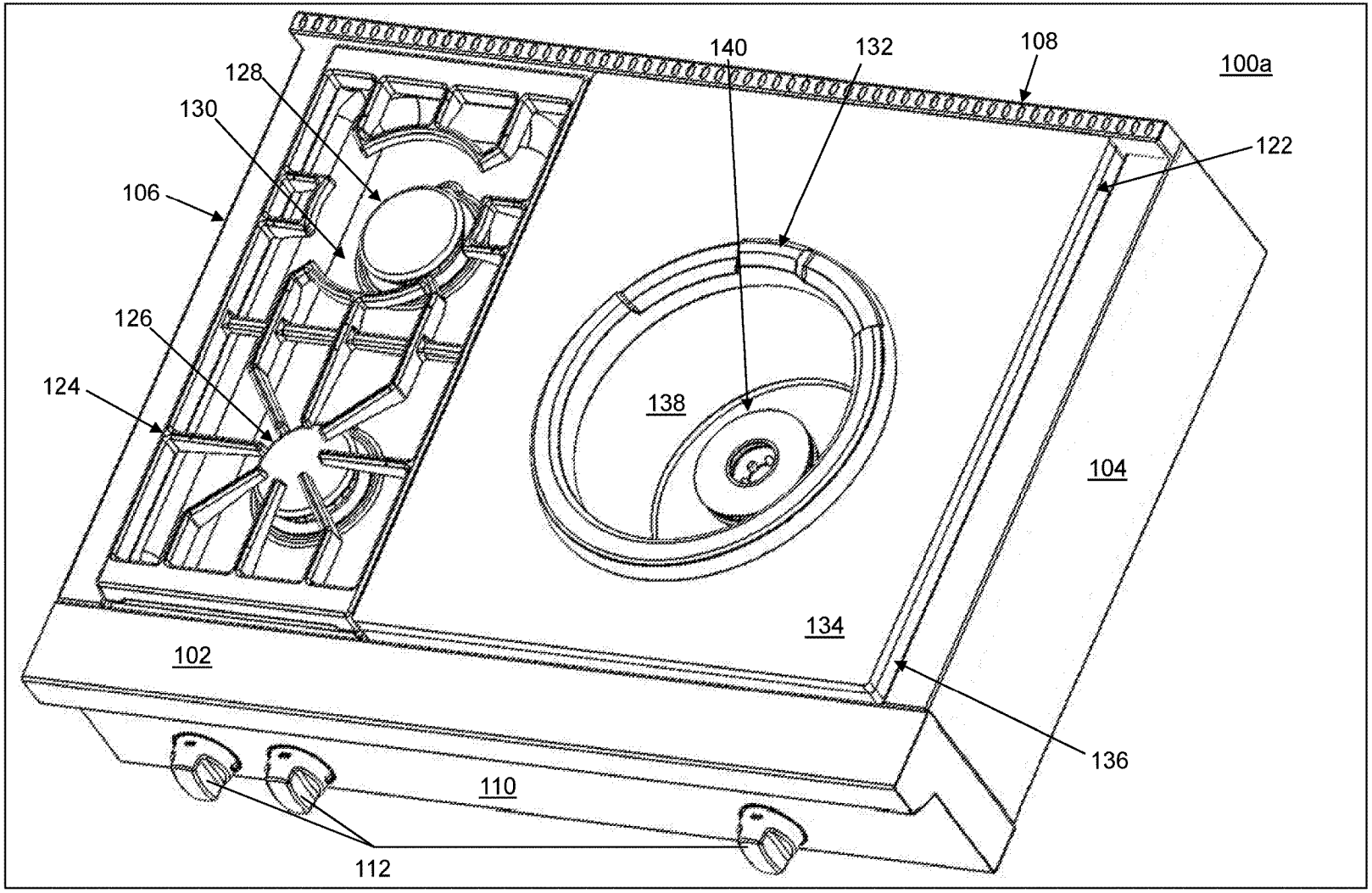
FIG. 2 depicts a top, front perspective view of a second cooktop with the wok burner assembly in accordance with an illustrative embodiment.

Referring to FIG. 1, a top, front perspective view of a first cooktop 100 with a wok burner assembly 122 is shown in accordance with an illustrative embodiment. Referring to FIG. 2, a top, front perspective view of a second cooktop 100*a* with wok burner assembly 122 is shown in accordance with an illustrative embodiment. First cooktop 100 and second cooktop 100*a* may be mounted to a counter or an oven or may integrated into a cabinet. First cooktop 100 and second cooktop 100*a* are gas cooktops that are connected to a supply of gas through an input gas line.

Figure 22:
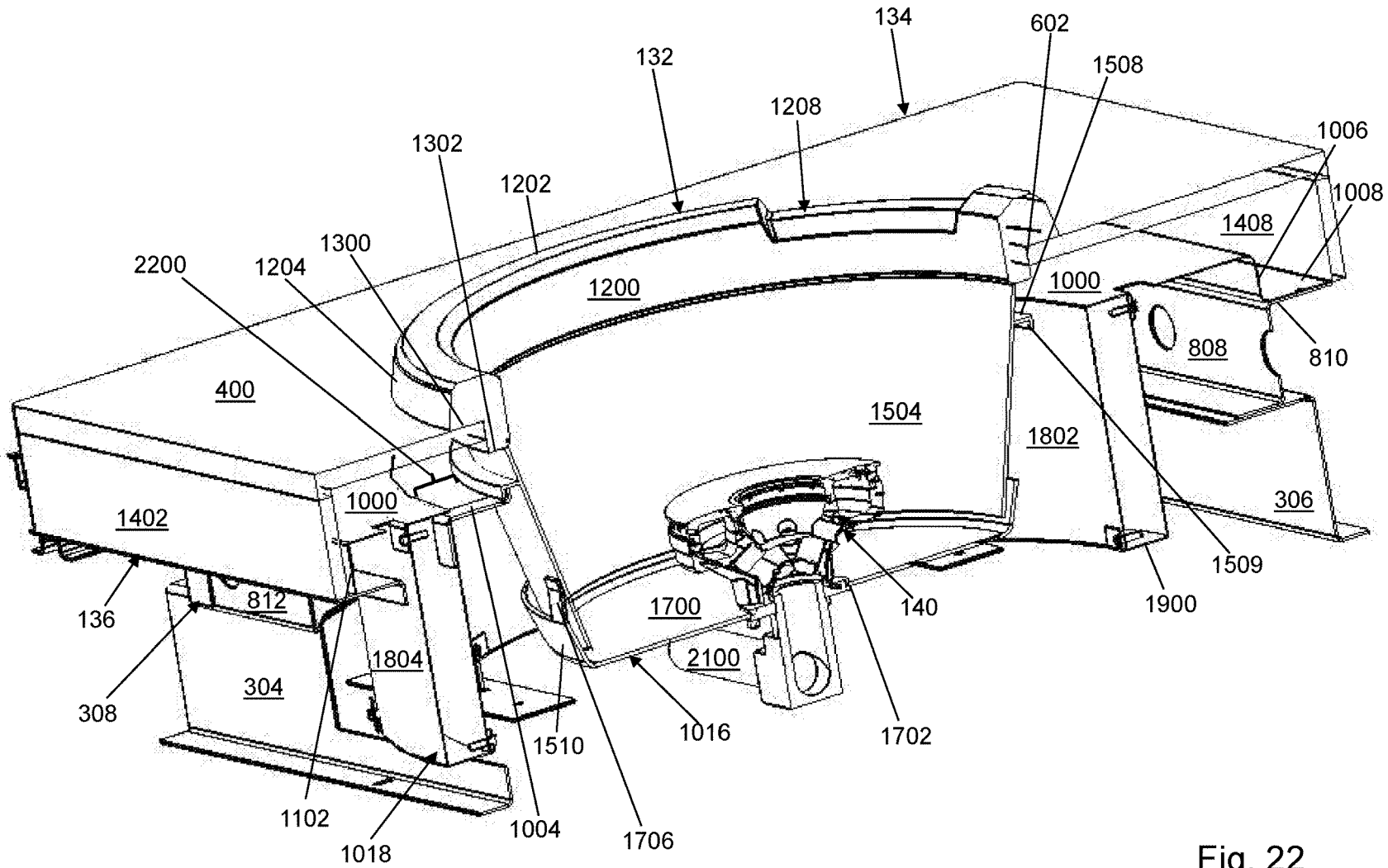
FIG. 22 depicts a right side perspective view of a Y-Z cross-section of the wok assembly of FIG. 4 in accordance with an illustrative embodiment.
Figure 23:
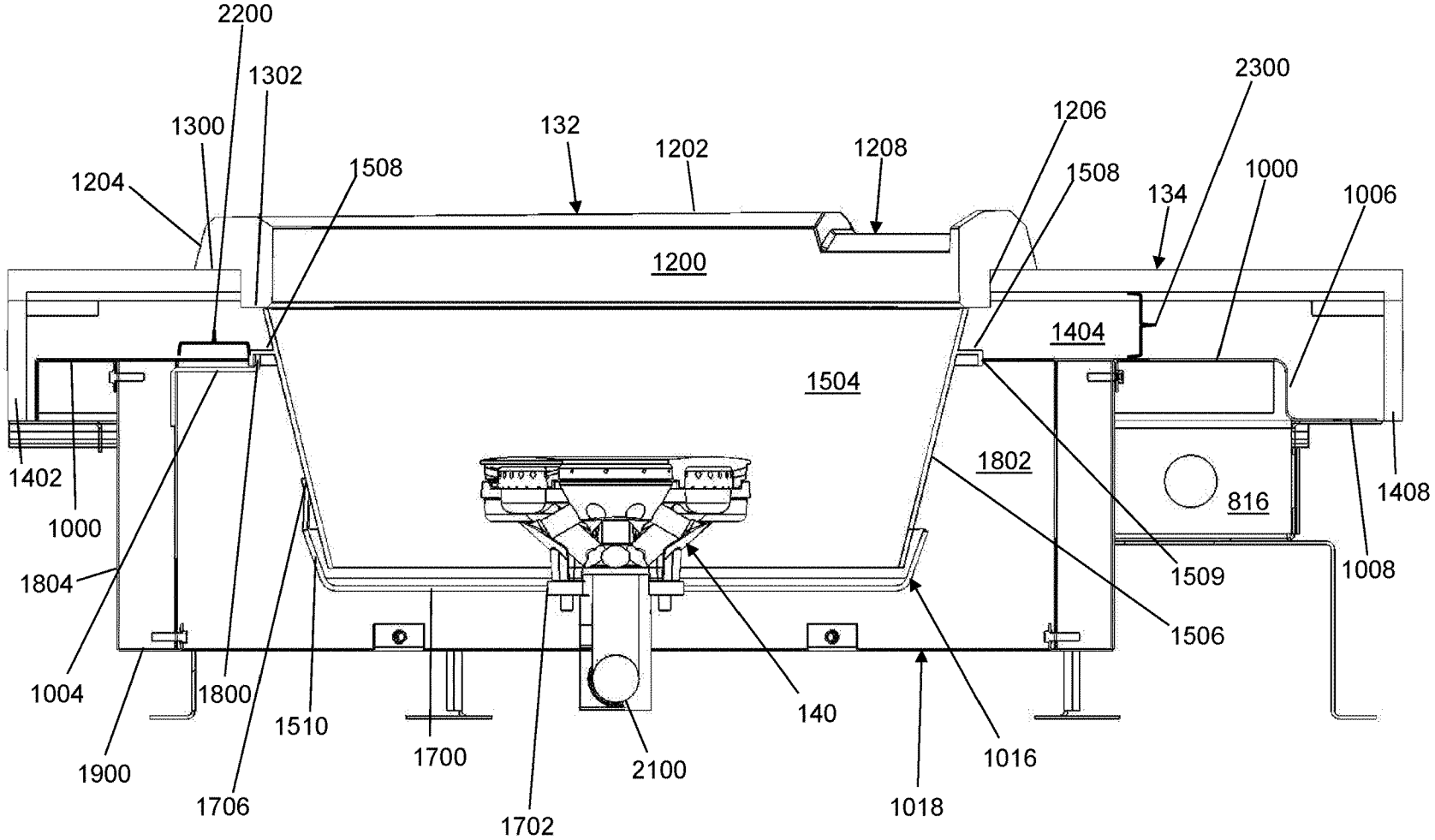
FIG. 23 depicts a right side view of the Y-Z cross-section of FIG. 22 in accordance with an illustrative embodiment.
Figure 25:
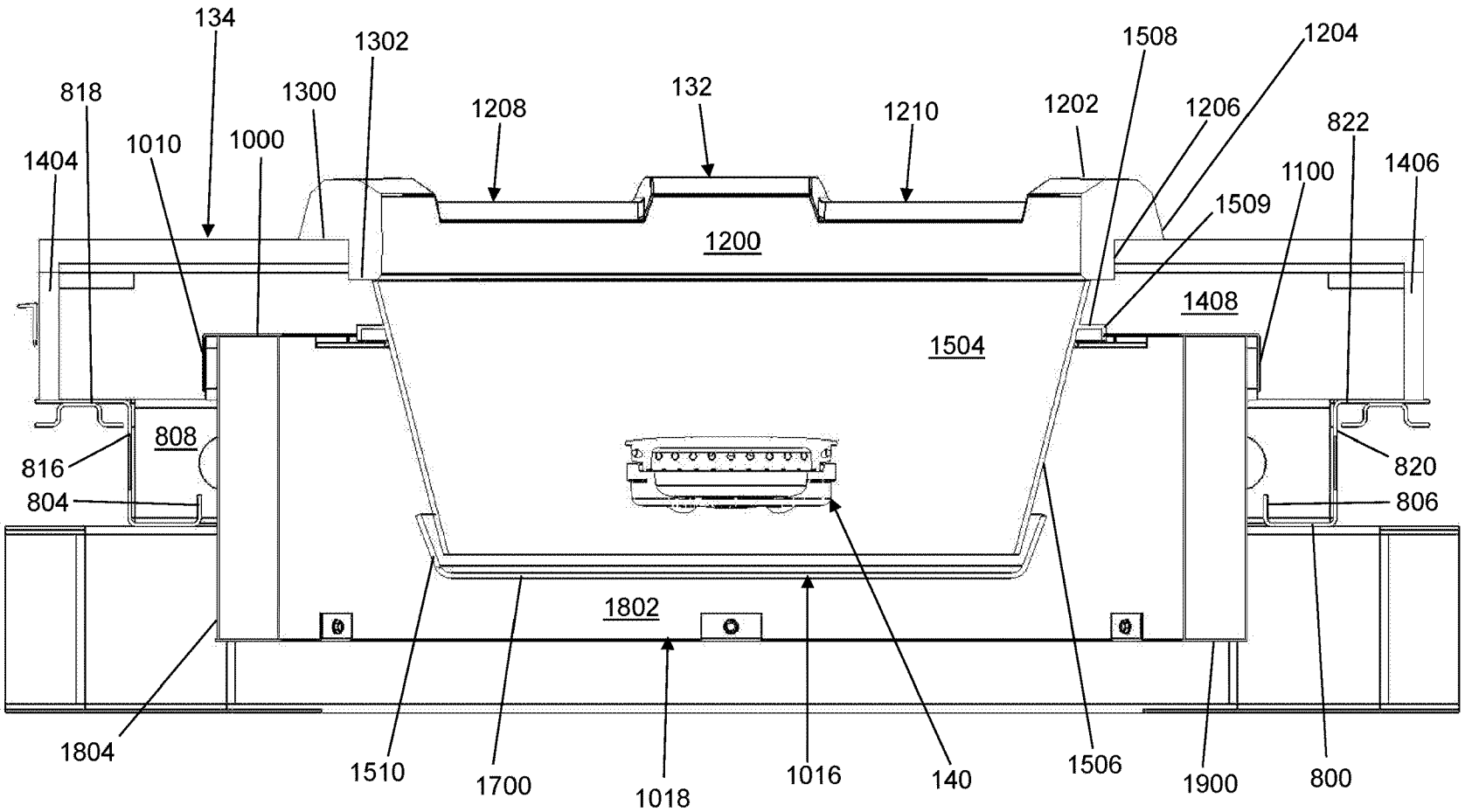
FIG. 25 depicts a front view of an X-Z cross-section of the wok burner assembly of FIG. 4 in accordance with an illustrative embodiment.

An "XYZ" coordinate reference frame is illustrated in FIG. 1. The cross-sections shown in FIGS. 22, 23, and 25 are with reference to the "XYZ" coordinate reference frame. The XZ plane generally defines a left-right plane, the YZ plane generally defines a front-back plane, and the XY plane generally defines an elevation plane.

First cooktop 100 and second cooktop 100*a* may include a front section 102, a right wall 104, a left wall 106, a back wall 300 (shown referring to FIG. 3), a bottom wall 302 (shown referring to FIG. 3), and a back vent conduit 108. Front section 102, right wall 104, left wall 106, back wall 300, and bottom wall 302 are mounted to each other to form a housing for one or more gas burners of first cooktop 100 and second cooktop 100*a*. A plurality of control knobs 112 are mounted to a front face 110 of front section 102 to control a flow of the gas to a respective burner. Back vent conduit 108 is mounted on back wall 300 to provide a vent for heat generated by operation of the one or more gas burners of first cooktop 100 and second cooktop 100*a*.

First cooktop 100 and second cooktop 100*a* may include various numbers of gas burners in various arrangements relative to wok burner assembly 122. A knob of the plurality of control knobs 112 is connected to each gas burner including a wok burner 140, as understood by a person of skill in the art, to control a flame produced by the respective burner. For illustration, first cooktop 100 includes five burners: a first burner 116, a second burner 118, wok burner 140, a third burner 126, and a fourth burner 128. As a result, the plurality of control knobs 112 of first cooktop 100 includes five knobs.

First burner 116, second burner 118, third burner 126, and fourth burner 128 may be rated to provide the same or a different number of units of energy that may be expressed, for example, in British thermal units (BTU) or in joules (J). One BTU may equal 1055.06 J as understood by a person of skill in the art. For example, first burner 116 and third burner 126 may provide a higher BTU than second burner 118. Fourth burner 128 may be a small BTU wok burner. Wok burner 140 may be a high BTU burner that supports cooking of food in a large wok. For example, wok burner 140 of wok burner assembly 122 may be rated to provide greater than ~22,000 BTU. In contrast, the small BTU wok burner of fourth burner 128 may be rated to provide between ~15,000 and ~22,000 BTU. Wok burner 140 may be a single valve with a single supply line and inner and outer burner ports on the burner ring.

For illustration, second cooktop 100*a* includes three burners: wok burner 140, third burner 126, and fourth burner 128. As a result, the plurality of control knobs 112 of second cooktop 100*a* includes three knobs. Third burner 126 and fourth burner 128 of first cooktop 100 have been moved to a left side of wok burner assembly 122 in the burner arrangement of second cooktop 100*a*. In alternative embodiments, wok burner assembly 122 may be integrated into a cooktop with any number and arrangement of burners rated to provide various BTU levels.

For illustration, first cooktop 100 further includes a first grate 114, a first drip pan 120, a second grate 124, and a second drip pan 130. For illustration, second cooktop 100*a* further includes second grate 124 and second drip pan 130. First grate 114 mounts between front section 102, left wall 106, back wall 300, and wok burner assembly 122 and extends over first burner 116 and second burner 118 to support various cooking receptacles as understood by a person of skill in the art. First drip pan 120 mounts between front section 102, left wall 106, back wall 300, and wok burner assembly 122 and below first burner 116 and second burner 118 to catch various items that fall between prongs of first grate 114 as understood by a person of skill in the art. First burner 116 and second burner 118 are mounted through openings in first drip pan 120.

Second grate 124 mounts between front section 102, right wall 104, back wall 300, and wok burner assembly 122 and extends over third burner 126 and fourth burner 128 to support various cooking receptacles. Second drip pan 130 mounts between front section 102, right wall 104, back wall 300, and wok burner assembly 122 and below third burner 126 and fourth burner 128 to catch various items that fall between prongs of second grate 124 as understood by a person of skill in the art. Third burner 126 and fourth burner 128 are mounted through openings in second drip pan 130. First grate 114 and second grate 124 may have various prong designs.

First burner 116, second burner 118, wok burner 140, third burner 126, and fourth burner 128 provide a flame to heat the various cooking receptacles placed on first grate 114, on second grate 124, and/or on a wok ring 132. The burners may be single or multiple level burners, such as a dual stack burner. Merely for illustration, each burner may be implemented similar to the stacked dual gas burner described in U.S. Pat. No. 6,322,354, which issued Nov. 27, 2001, to Wolf Appliance Inc., the assignee of the present application. Other gas burner designs may be used. The burners may be arranged in manners other than that shown in the illustrative embodiments of FIGS. 1 and 2. For example, first cooktop 100 and second cooktop 100*a* may include a greater or a fewer number of burners.

First cooktop 100 and second cooktop 100*a* may include a greater or a fewer number of components. The one or more components of first cooktop 100 and second cooktop 100*a* may be formed of one or more materials, such as various metals (i.e., stainless steel, cast iron, etc.) glass, and/or plastics having a sufficient strength and rigidity as well as thermal and permeability properties sufficient to support the described application.

As used herein, the term "mount" includes join, unite, connect, couple, associate, insert, hang, hold, affix, attach, fasten, bind, paste, secure, hinge, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element) unless specified otherwise. Elements referenced as mounted to each other herein may further be integrally formed together, for example, using a molding or thermoforming process as understood by a person of skill in the art. As a result, elements described herein as being mounted to each other need not be discrete structural elements unless specified otherwise. The elements may be mounted permanently, removably, or releasably unless specified otherwise.

Use of directional terms, such as top, bottom, right, left, front, back, upper, lower, horizontal, vertical, behind, etc. are merely intended to facilitate reference to the various surfaces of the described structures relative to the orientations introduced in the drawings and are not intended to be limiting in any manner unless otherwise indicated.

Figure 21:
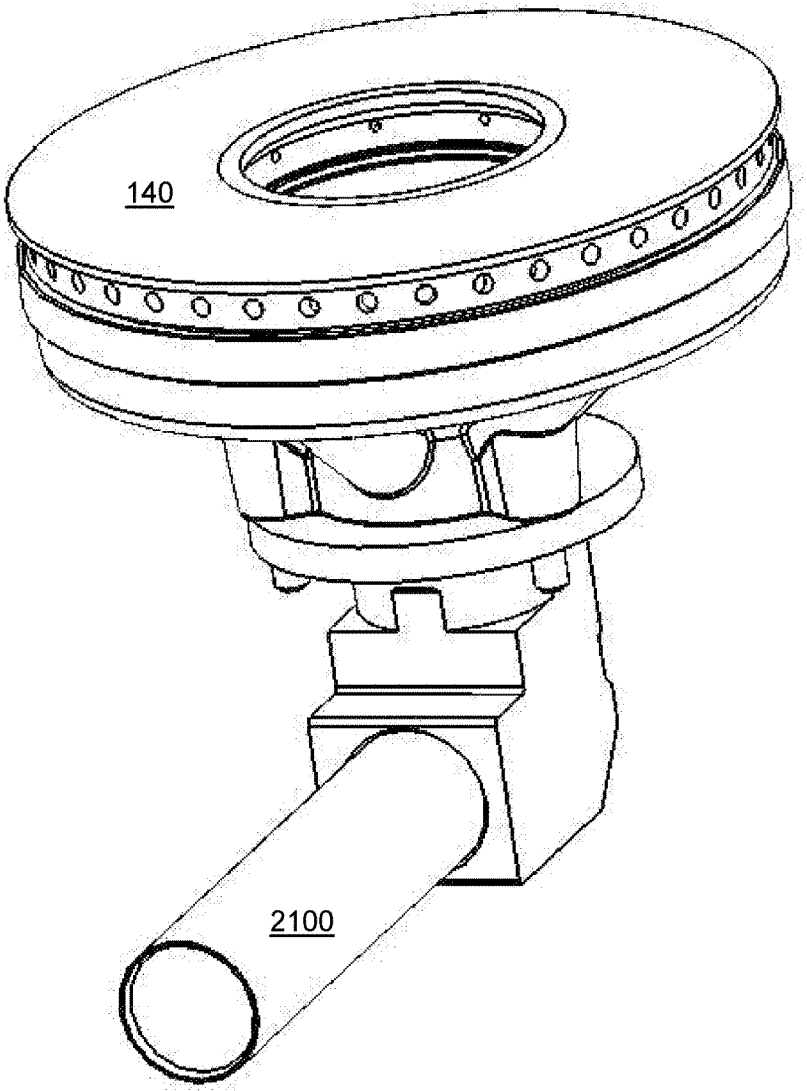
FIG. 21 depicts a side perspective view of a wok burner of the wok burner assembly of FIG. 4 in accordance with an illustrative embodiment.

Wok burner assembly 122 may include wok ring 132, a top plate 134, an outer support frame 136, a chimney assembly 138, wok burner 140, a front brace 304 (shown referring to FIG. 3), a back brace 306 (shown referring to FIG. 3), a vent frame 308 (shown referring to FIG. 3), a support platform 600 (shown referring to FIG. 6), and a gas line 2100 (shown referring to FIG. 21). Gas line 2100 connects wok burner 140 to a knob of the plurality of control knobs 112 to allow a user to adjust a flame from wok burner 140 by rotating the knob.

Figure 3:
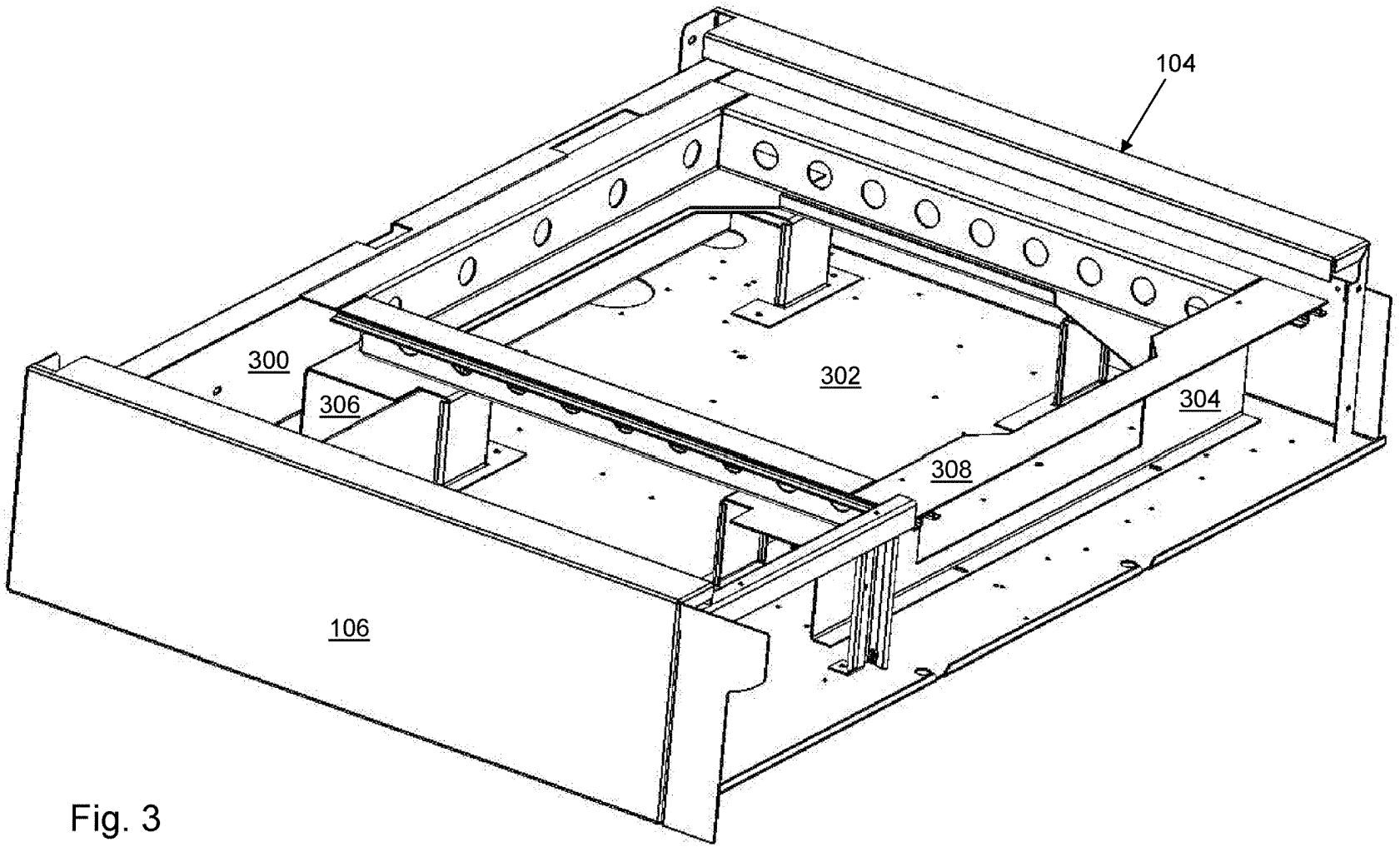
FIG. 3 depicts a left perspective view of a support structure of the wok burner assembly in accordance with an illustrative embodiment.

Referring to FIG. 3, a left perspective view of a support structure of wok assembly 122 is shown in accordance with an illustrative embodiment. Front brace 304 and back brace 306 mount to bottom wall 302 to position wok assembly 122 at an appropriate location within front section 102, right wall 104, left wall 106, and back wall 300. For illustration, various types of fasteners may be used to mount front brace 304 and back brace 306 to bottom wall 302. A fewer or a greater number of braces of various sizes and shapes may be used. Vent frame 308 is mounted to a top surface of front brace 304 and back brace 306.

Figure 4:
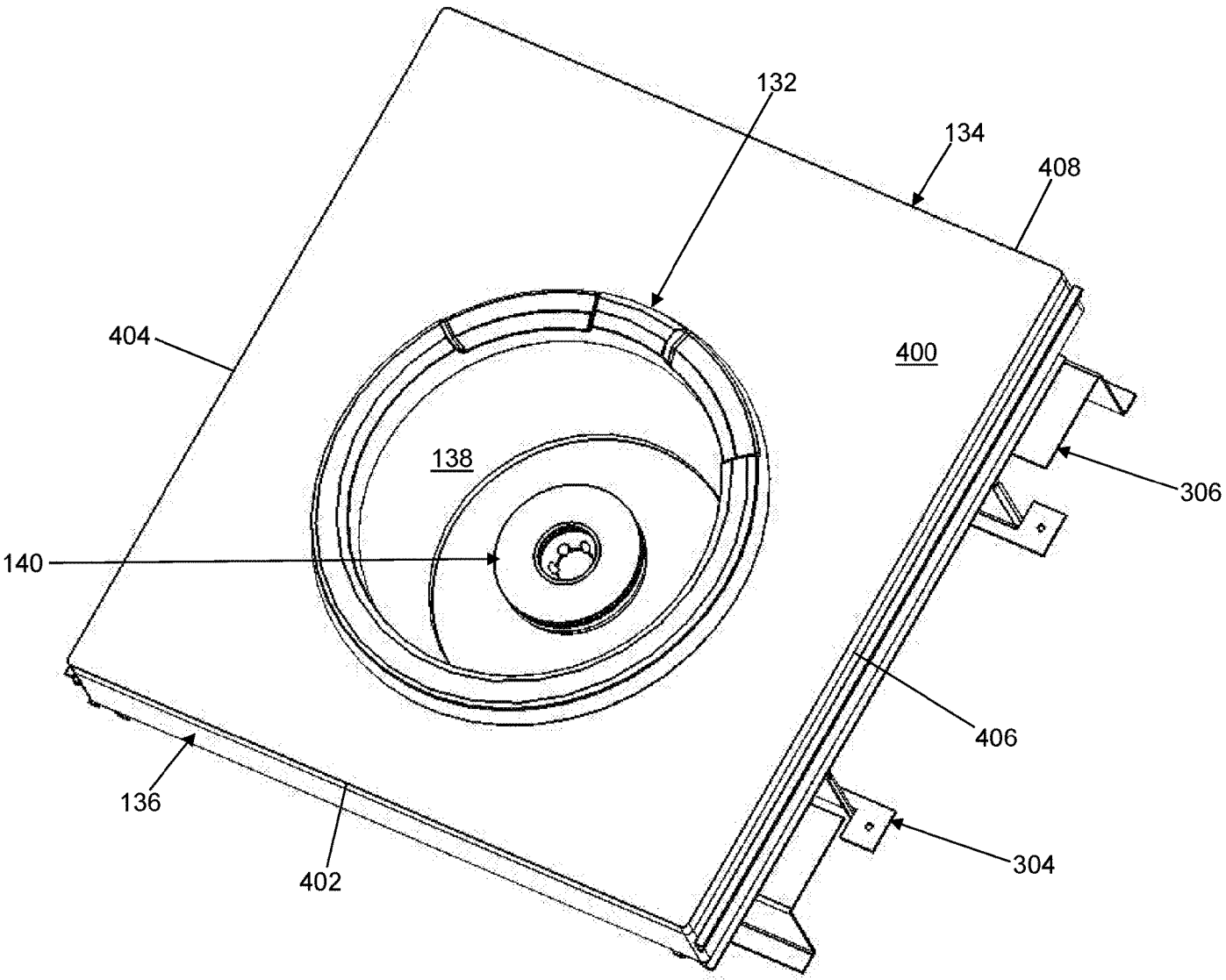
FIG. 4 depicts a top, front perspective view of the wok burner assembly removed from the cooktop in accordance with an illustrative embodiment.
Figure 5:
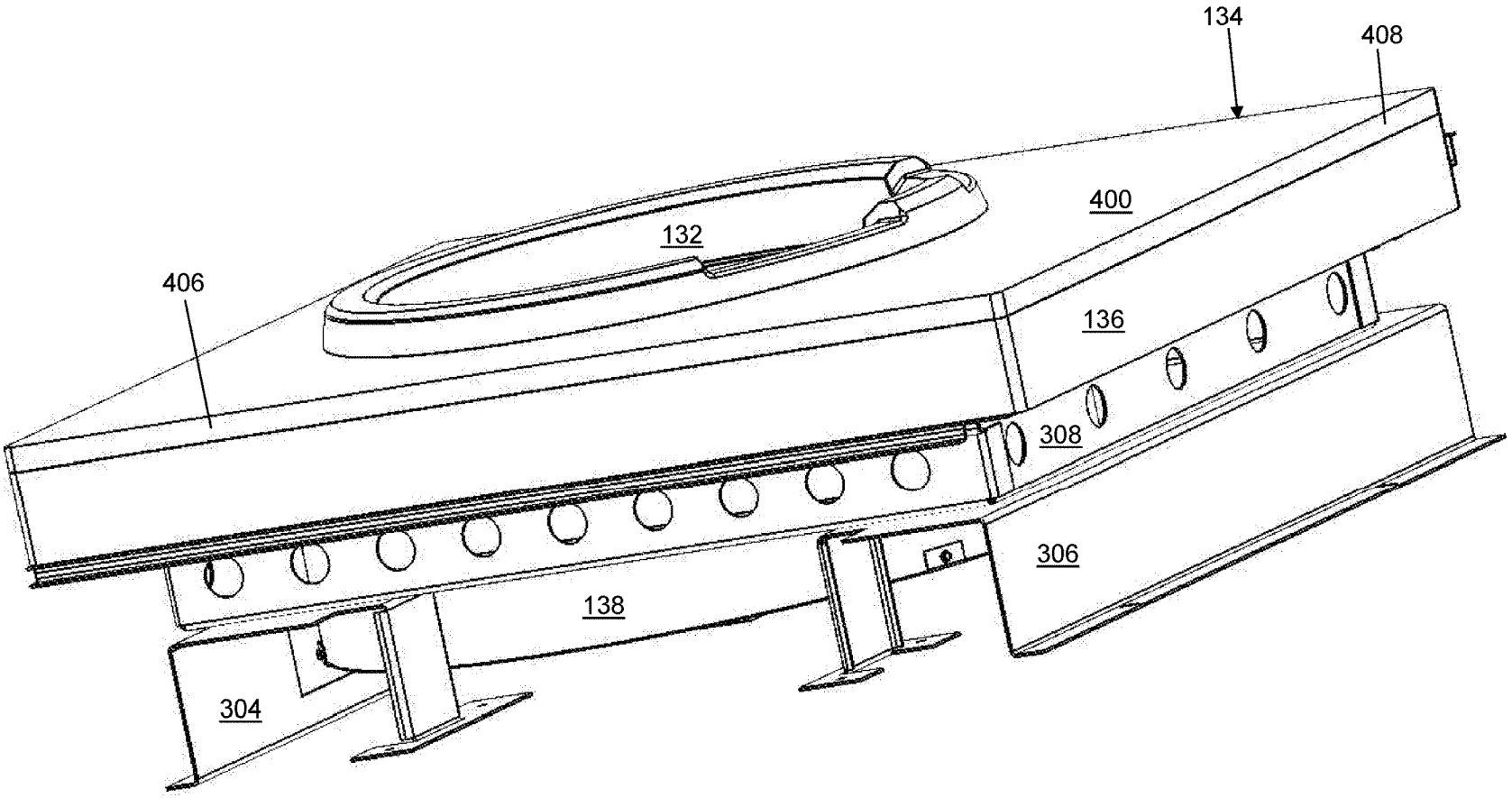
FIG. 5 depicts a right side perspective view of the wok burner assembly of FIG. 4 in accordance with an illustrative embodiment.
Figure 6:
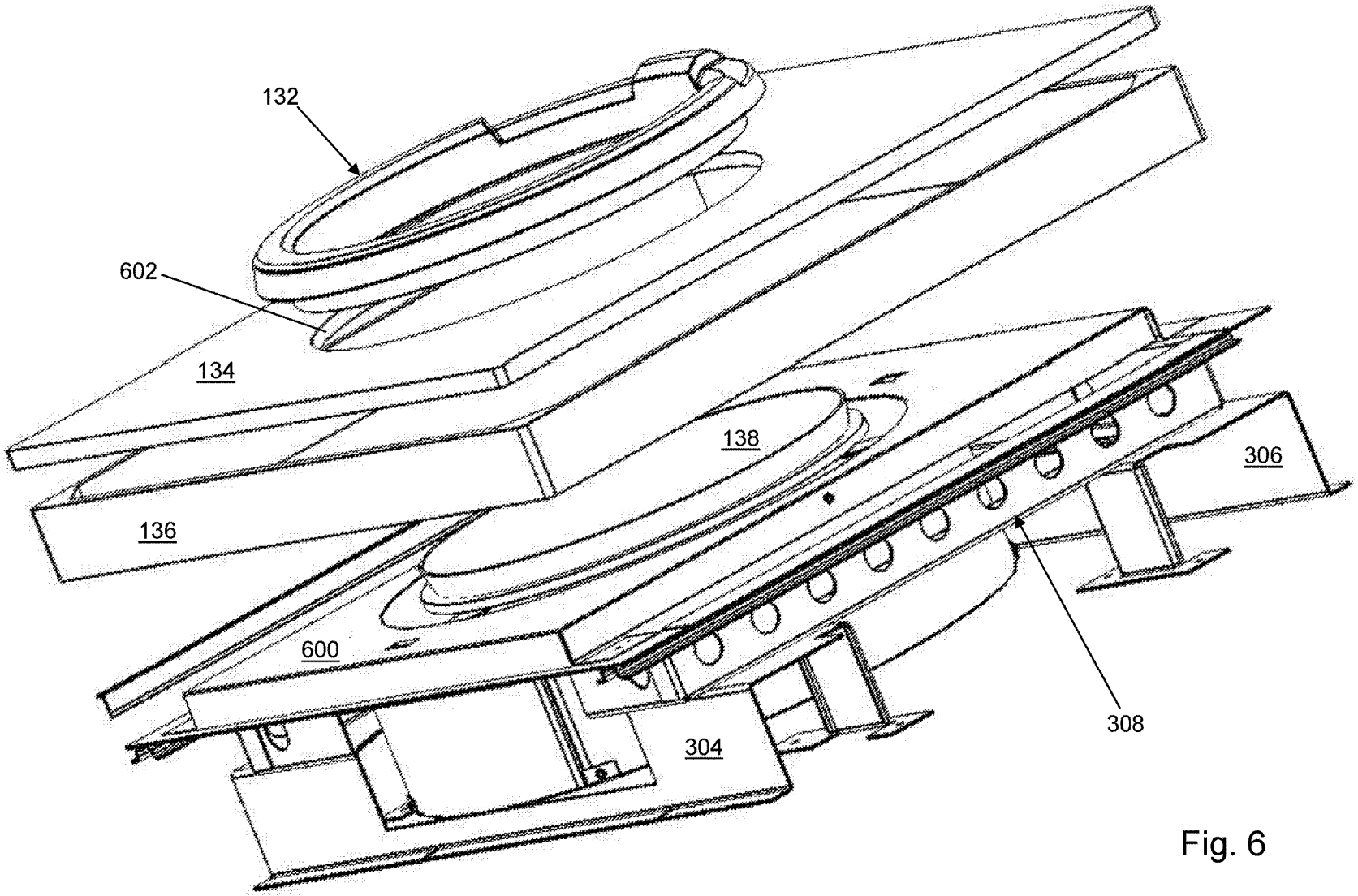
FIG. 6 depicts a front, right exploded view of the wok burner assembly of FIG. 4 in accordance with an illustrative embodiment.
Figure 7:
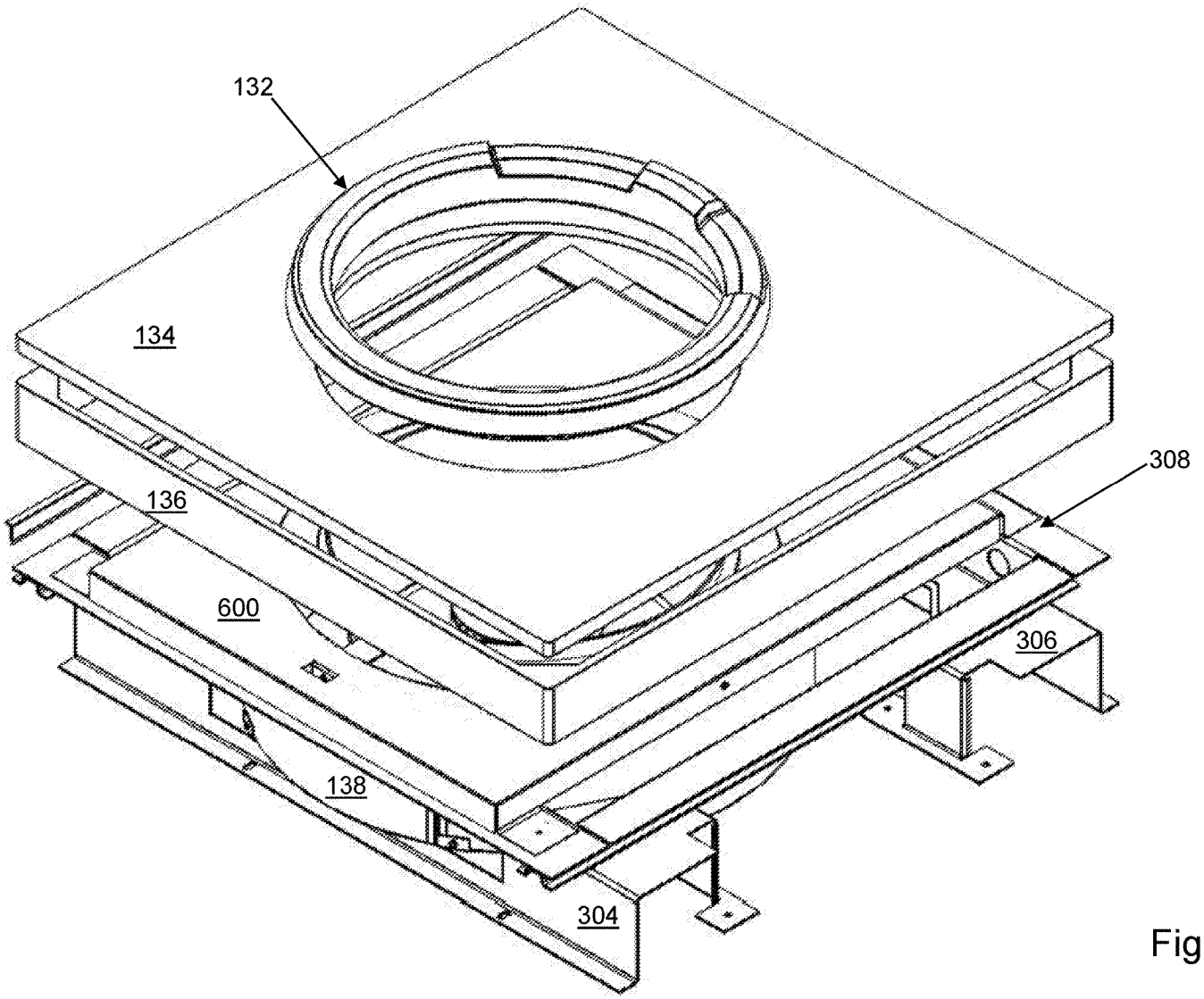
FIG. 7 depicts a front, top exploded view of the wok burner assembly of FIG. 4 in accordance with an illustrative embodiment.

Referring to FIG. 4, a top, front perspective view of wok assembly 122 removed from second cooktop 100*a* (or first cooktop 100) is shown in accordance with an illustrative embodiment. Referring to FIG. 5, a right side perspective view of wok assembly 122 is shown in accordance with an illustrative embodiment. Referring to FIG. 6, a front, right exploded view of wok assembly 122 is shown in accordance with an illustrative embodiment. Referring to FIG. 7, a front, top exploded view of wok assembly 122 is shown in accordance with an illustrative embodiment.

In the illustrative embodiment, top plate 134 may include a top wall 400, a front wall 402, a left side wall 404, a right side wall 406, a back wall 408, and a top plate ring aperture wall 602 (shown referring to FIG. 6). Front wall 402, left side wall 404, right side wall 406, and back wall 408 extend from edges of top wall 400. Top wall 400 may have an upper surface and a lower surface where the upper surface is visible by a user of second cooktop 100*a* (or first cooktop 100). In the illustrative embodiments, front wall 402, left side wall 404, right side wall 406, and back wall 408 extend below the lower surface of top wall 400 to align with top surfaces of first grate 114 and of second grate 124 though this is not required.

In the illustrative embodiments, top wall 400 is generally rectangular though top wall 400 may have other shapes in other embodiments. For example, top wall 400 may form other polygons, a circle, an ellipse, etc. Top plate ring aperture wall 602 is formed through top wall 400 and is sized and shaped to accommodate at least a portion of wok ring 132 therethrough. Top plate ring aperture wall 602 is generally circular though top plate ring aperture wall 602 may have other shapes in other embodiments. For example, top plate ring aperture wall 602 may form a polygon, an ellipse, etc. For illustration, top plate 134 may be formed of stainless steel or cast iron with various finishes.

Figure 8:
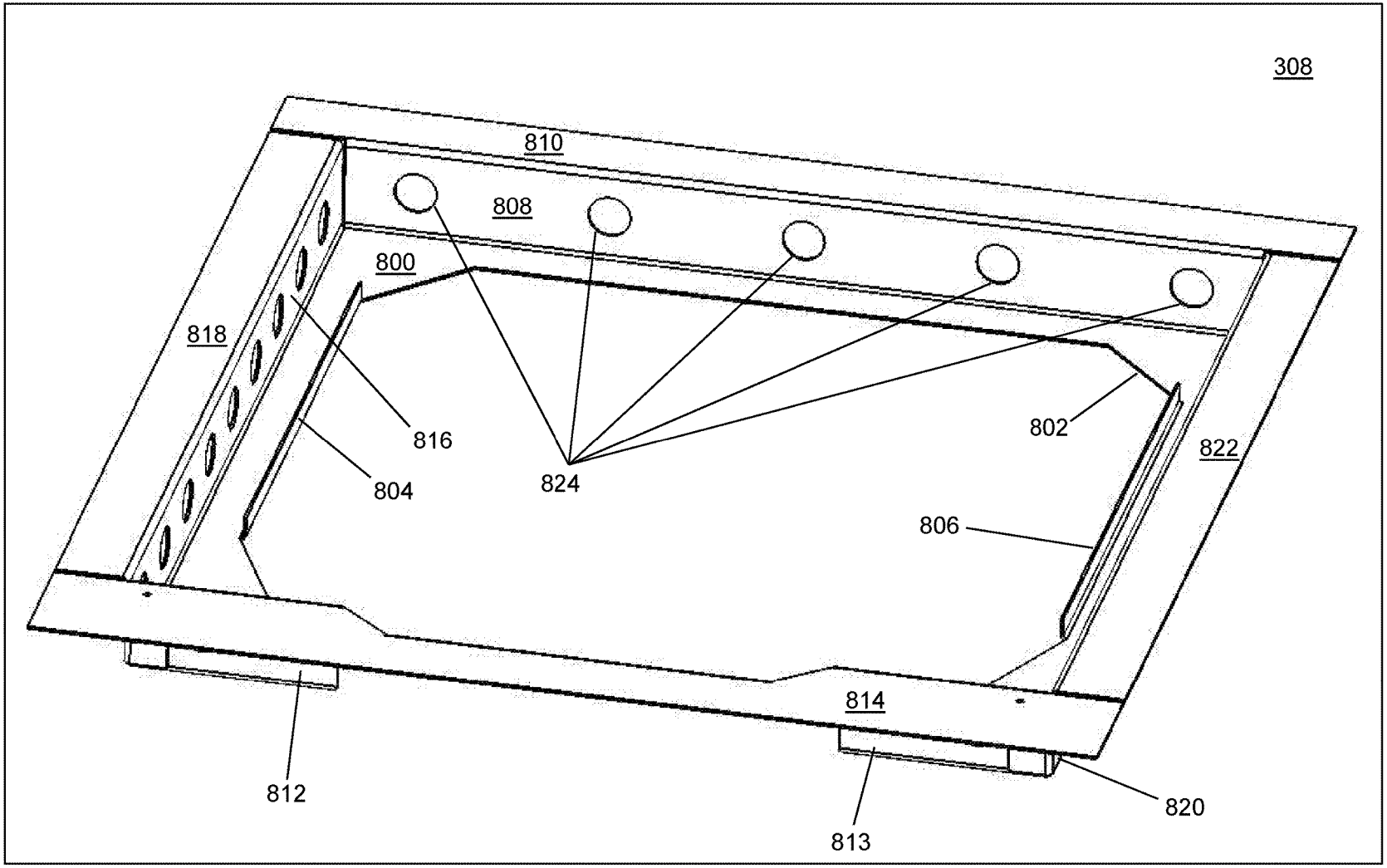
FIG. 8 depicts a front, top perspective view of a vent frame of the wok burner assembly of FIG. 4 in accordance with an illustrative embodiment.
Figure 9:
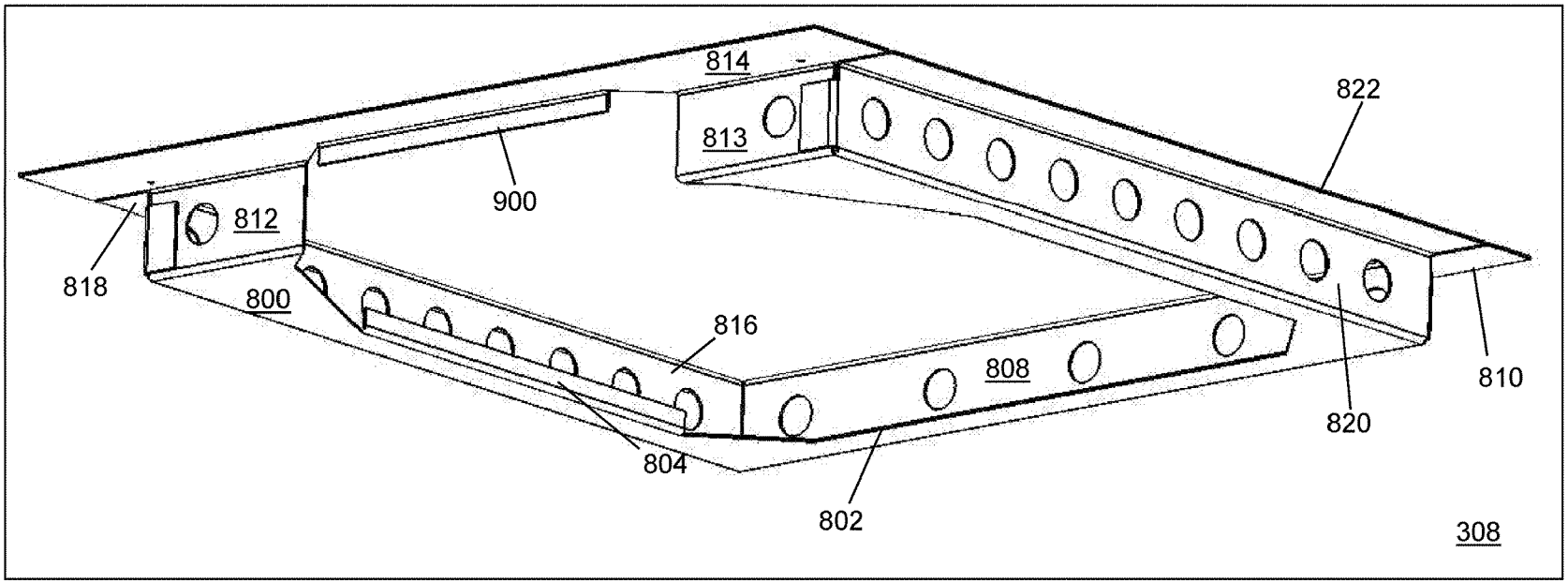
FIG. 9 depicts a front, bottom perspective view of the vent frame of FIG. 8 in accordance with an illustrative embodiment.

Referring to FIG. 8, a front, top perspective view of vent frame 308 of wok assembly 122 is shown in accordance with an illustrative embodiment. Referring to FIG. 9, a front, bottom perspective view of vent frame 308 is shown in accordance with an illustrative embodiment. Vent frame 308 may be formed of various materials such as metal. In the illustrative embodiments, vent frame 308 is generally rectangular though vent frame 308 may have other shapes in other embodiments. For example, vent frame 308 may form other polygons, a circle, an ellipse, etc. For illustration, various types of fasteners may be used to mount vent frame 308 to front brace 304 and back brace 306 and/or to bottom wall 302.

Vent frame 308 may include a bottom wall 800, a chimney aperture wall 802, a left upturned edge 804, a right upturned edge 806, a back wall 808, a back flange 810, a front left wall 812, a front right wall 813, a front flange 814, a left side wall 816, a left side flange 818, a right side wall 820, a right side flange 822, and a front downturned edge 900 (shown referring to FIG. 9). Bottom wall 800 extends horizontally from portions of back wall 808, front left wall 812, front right wall 813, left side wall 816, and right side wall 820.

Chimney aperture wall 802 is formed through bottom wall 800 and is sized to accommodate chimney assembly 138. A portion of chimney aperture wall 802 extends along a right side of front left wall 812 and along a left side of front right wall 813 and in a portion of front flange 814. Chimney aperture wall 802 is generally rectangular with chamfered corners adjacent the corner between each pair of walls. Chimney aperture wall 802 is generally rectangular though chimney aperture wall 802 may have other shapes in other embodiments. For example, chimney aperture wall 802 may form other polygons, a circle, an ellipse, etc.

Left upturned edge 804 and right upturned edge 806 extend up from a portion of chimney aperture wall 802 of bottom wall 800. Left upturned edge 804 extends generally parallel to left side wall 816. Right upturned edge 804 extends generally parallel to right side wall 820. Front downturned edge 900 extends down from a second portion of chimney aperture wall 802 of bottom wall 800. Front downturned edge 900 extends generally parallel to front left wall 812 and front right wall 813. The opening between front left wall 812 and front right wall 813 provides an area for gas piping for wok burner 140, wiring for an igniter and for flame sensing, etc.

Back wall 808, front left wall 812, front right wall 813, left side wall 816, and right side wall 820 extend vertically up from bottom wall 800 and may each include one or more apertures through which heat can escape from wok assembly 122. For example, back wall 808 includes a plurality of apertures 824. Each wall of vent frame 308 may include a fewer or a greater number of apertures of various sizes and shapes.

Back flange 810 extends horizontally from back wall 808 generally parallel to bottom wall 800 though in a direction opposite to bottom wall 800. Front flange 814 extends horizontally from front left wall 812 and from front right wall 813 and generally parallel to bottom wall 800 though in a direction opposite to bottom wall 800. Left side flange 818 extends horizontally from left side wall 816 generally parallel to bottom wall 800 though in a direction opposite to bottom wall 800. Right side flange 822 extends horizontally from right side wall 820 generally parallel to bottom wall 800 though in a direction opposite to bottom wall 800. Back flange 810, front flange 814, left side flange 818, and right side flange 822 form a support for support platform 600.

Figure 10:
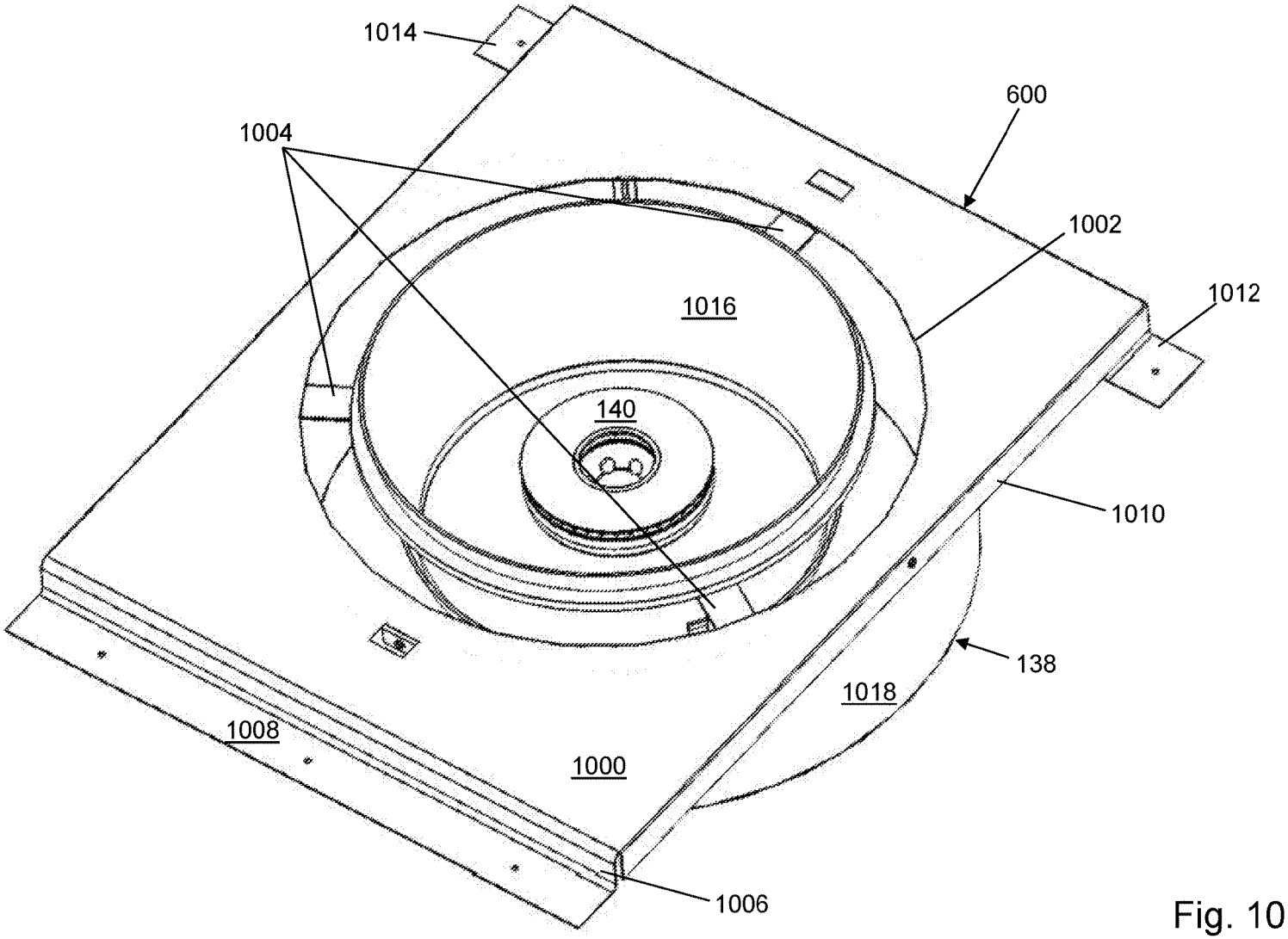
FIG. 10 depicts a front, top perspective view of a chimney assembly and a support platform of the wok burner assembly of FIG. 4 in accordance with an illustrative embodiment.
Figure 11:
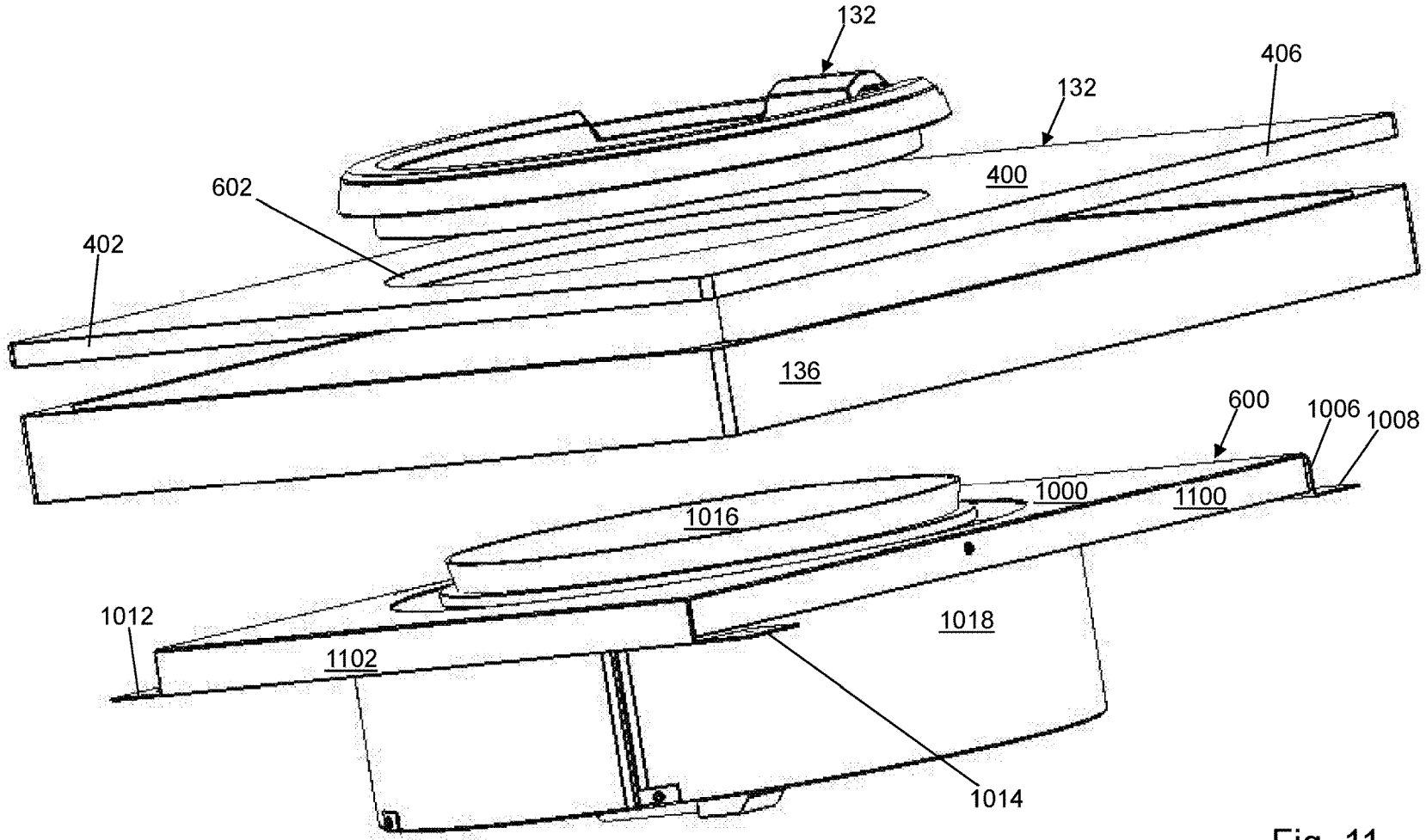
FIG. 11 depicts a front, right exploded view of components of the wok burner assembly of FIG. 4 in accordance with an illustrative embodiment.

Referring to FIG. 10, a front, top perspective view of chimney assembly 138 and support platform 600 are shown in accordance with an illustrative embodiment. Referring to FIG. 11, a front, right exploded view of components of wok assembly 122 are shown in accordance with an illustrative embodiment. Chimney assembly 138 may include a cone assembly 1016, a chimney 1018, and a plurality of tabs 1004 that mount cone assembly 1016 to chimney 1018.

Support platform 600 may include a top support wall 1000, a flue aperture wall 1002, a back support wall 1006, a back support flange 1008, a left support wall 1010, a right support wall 1100, a front support wall 1102, a left mounting tab 1012, and a right mounting tab 1014. Back support wall 1006, left support wall 1010, right support wall 1100, and front support wall 1102 extend vertically down from top support wall 1000. Top support wall 1000 may be formed of various materials such as metal. In the illustrative embodiments, top support wall 1000 is generally rectangular though top support wall 1000 may have other shapes in other embodiments. For example, top support wall 1000 may form other polygons, a circle, an ellipse, etc.

Flue aperture wall 1002 is formed through top support wall 1000 and is sized to accommodate cone assembly 1016 and a chimney opening width 2200 (shown referring to FIG. 22) between cone assembly 1016 and chimney 1018. The plurality of tabs 1004 extend across chimney opening width 2200. Flue aperture wall 1002 is generally circular though flue aperture wall 1002 may have other shapes in other embodiments. For example, flue aperture wall 1002 may form a polygon, an ellipse, etc. Chimney opening width 2200 allows a removal of cone assembly 1016 for cleaning and any other service needs.

The plurality of tabs 1004 may support cone assembly 1016. A number and a positioning of the plurality of tabs 1004 may be selected to support cone assembly 1016 above bottom wall 302. For illustration, the number of the plurality of tabs may range from two tabs to twelve tabs. The plurality of tabs 1004 may be distributed equally around flue aperture wall 1002.

Back support flange 1008 extends horizontally from back support wall 1006 generally parallel to top support wall 1000 though in a direction opposite to top support wall 1000. Left mounting tab 1012 extends horizontally from left support wall 1010 generally parallel to top support wall 1000 though in a direction opposite to top support wall 1000. Right mounting tab 1014 extends horizontally from right support wall 1100 generally parallel to top support wall 1000 though in a direction opposite to top support wall 1000. Back support flange 1008, left mounting tab 1012, and right mounting tab 1014 may include apertures to accommodate various types of fasteners that may be used to mount support platform 600 to vent frame 308, to front brace 304 and back brace 306, and/or to bottom wall 302. Support platform 600 may further mount to chimney assembly 138 using various fasteners.

Figure 12:
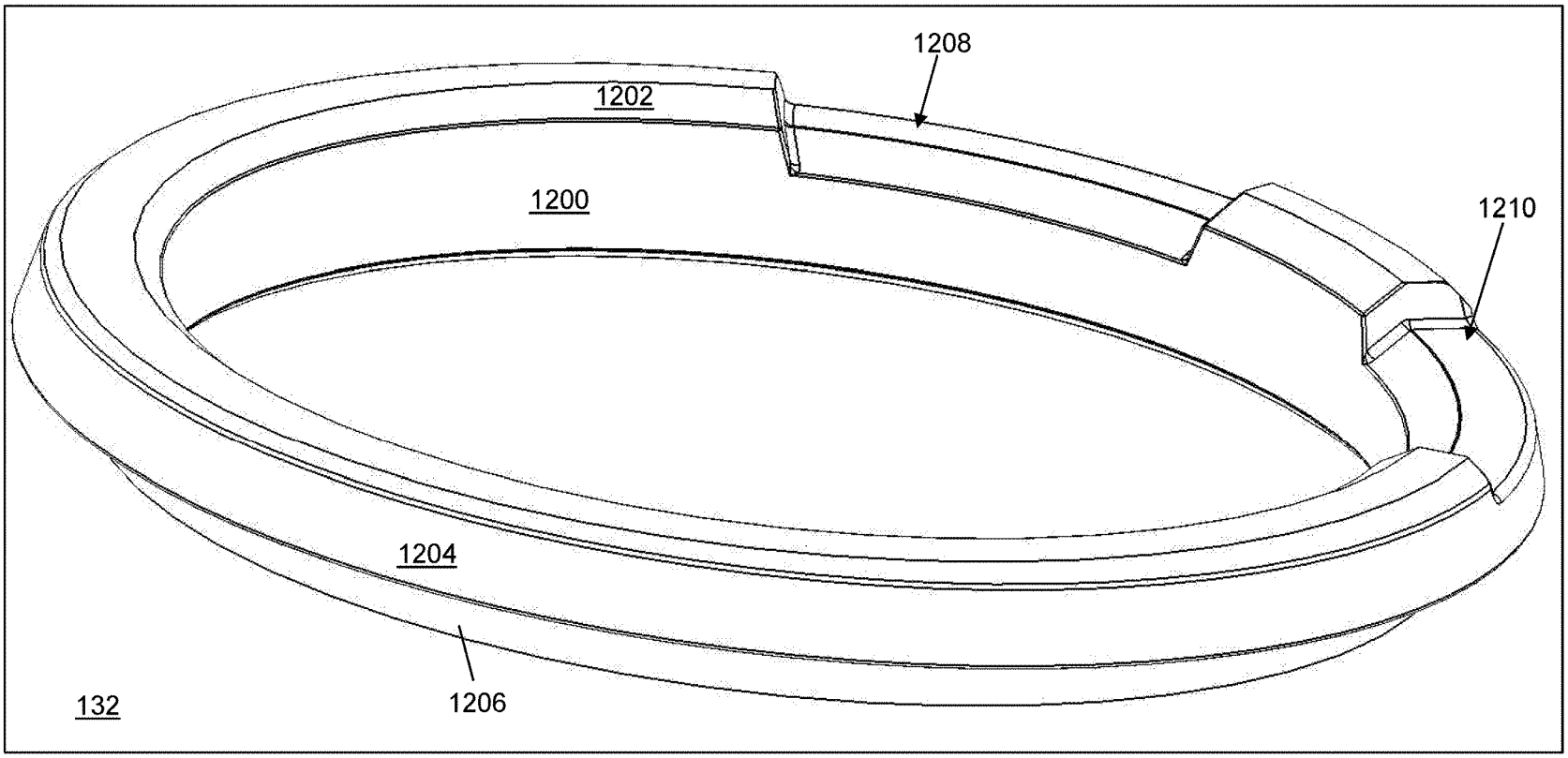
FIG. 12 depicts a front, top perspective view of a wok ring of the wok burner assembly of FIG. 4 in accordance with an illustrative embodiment.
Figure 13:
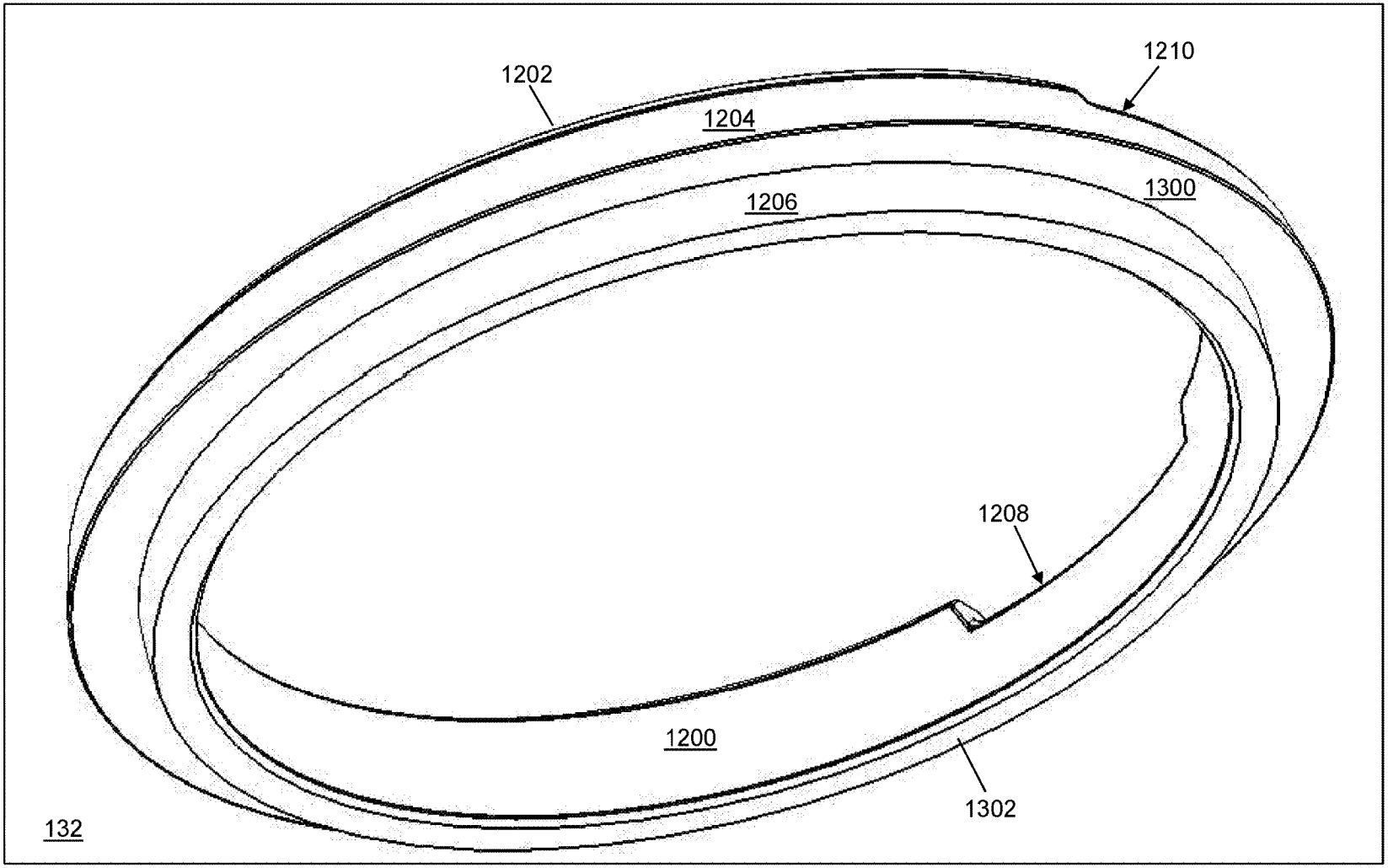
FIG. 13 depicts a front, bottom perspective view of the wok ring of FIG. 12 in accordance with an illustrative embodiment.

Referring to FIG. 12, a front, top perspective view of wok ring 132 is shown in accordance with an illustrative embodiment. Referring to FIG. 13, a front, bottom perspective view of wok ring 132 is shown in accordance with an illustrative embodiment. Wok ring 132 may be formed of various materials such as metal. Wok ring 132 may include a ring aperture wall 1200, a ring top wall 1202, a ring top outer wall 1204, a ring flange 1300, a ring bottom outer wall 1206, a bottom wall 1302, a first notch 1208, and a second notch 1210. Ring aperture wall 1200 extends generally vertically and is sized to accommodate a bottom of a large wok. For example, ring aperture wall 1200 may have a circumference in the range of ~200 to ~610 millimeters (mm) to accommodate different sized woks. Ring aperture wall 1200 is generally circular though ring aperture wall 1200 may have other shapes in other embodiments. For example, ring aperture wall 1200 may form a polygon, an ellipse, etc.

Ring top wall 1202 extends generally horizontally from ring aperture wall 1200 away from a center of ring aperture wall 1200. A chamfered edge may be formed as a transition between ring aperture wall 1200 and ring top wall 1202. Ring top outer wall 1204 extends generally vertically down from ring top wall 1202. A second chamfered edge may be formed as a transition between top outer wall 1204 and ring top wall 1202. Ring top outer wall 1204 further may slope outward from ring top wall 1202 to ring flange 1300.

First notch 1208 and second notch 1210 are formed as notches in ring top wall 1202. First notch 1208 and second notch 1210 may be sized and shaped to facilitate a flow of hot air from wok burner 140. Wok ring 132 may include a fewer or a greater number of notches.

Ring flange 1300 extends generally horizontally from top outer wall 1204 toward a center of ring aperture wall 1200. Ring flange 1300 forms a flat surface for supporting wok ring 132 on top wall 400 of top plate 134 within top plate ring aperture wall 602. Ring bottom outer wall 1206 extends generally vertically down from ring flange 1300. Ring bottom outer wall 1206 is sized and shaped to fit within and to generally abut top plate ring aperture wall 602. Bottom wall 1302 extends generally horizontally from ring bottom outer wall 1206 toward a center of ring aperture wall 1200. Bottom wall 1302 extends between ring bottom outer wall 1206 and ring aperture wall 1200. A third chamfered edge may be formed as a transition between bottom wall 1302 and ring aperture wall 1200.

Figure 14:
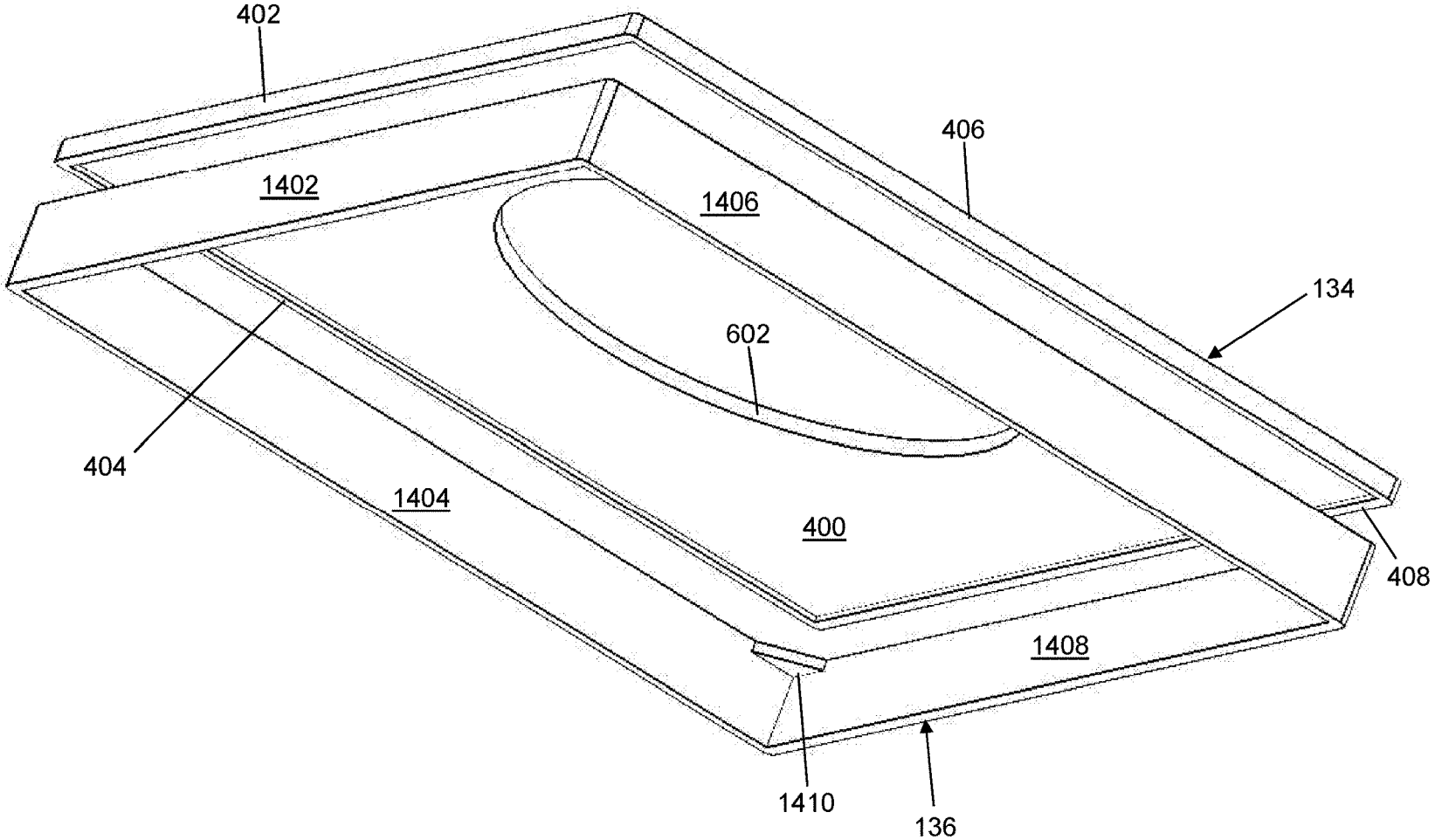
FIG. 14 depicts a front, bottom perspective view of a top plate and an outer support frame of the wok burner assembly of FIG. 4 in accordance with an illustrative embodiment.

Referring to FIG. 14, a front, bottom perspective view of top plate 134 and outer support frame 136 is shown in accordance with an illustrative embodiment. Outer support frame 136 may include a front wall 1402, a left wall 1404, a right wall 1406, a back wall 1408, and one or more corner braces 1410. Front wall 1402 is mounted between first edges of left wall 1404 and right wall 1406. Back wall 1408 is mounted between second edges of left wall 1404 and right wall 1406. Front wall 1402, left wall 1404, right wall 1406, and back wall 1408 are mounted to form a vertical support frame. The one or more corner braces 1410 may be positioned between a pair of walls to provide additional strength and stability to outer support frame 136.

Top plate 134 is mounted on outer support frame 136 to cover the opening between front wall 1402, left wall 1404, right wall 1406, and back wall 1408. Outer support frame 136 may be sized and shaped to align vertically with top plate 134 when top plate 134 is mounted on outer support frame 136. Outer support frame 136 may be formed of various materials such as metal. In the illustrative embodiments, outer support frame 136 is generally rectangular though outer support frame 136 may have other shapes in other embodiments. For example, outer support frame 136 may form other polygons, a circle, an ellipse, etc. For illustration, various types of fasteners may be used to mount front wall 1402, left wall 1404, right wall 1406, and back wall 1408 to each other to form outer support frame 136. Outer support frame 136 and top plate 134 may be integrally formed together. Outer support frame 136 may rest on top plate 134.

Figure 15:
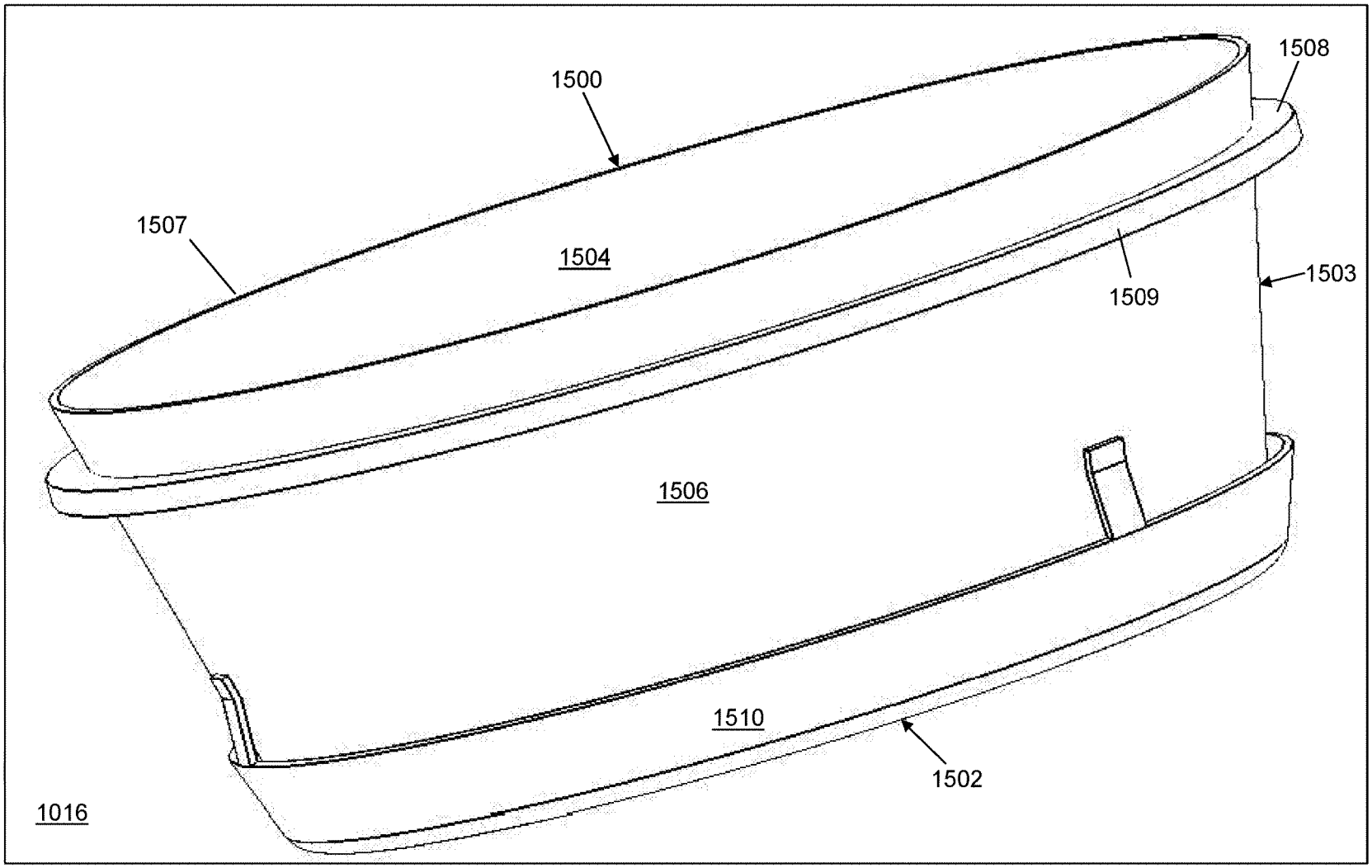
FIG. 15 depicts a side perspective view of a cone assembly of the chimney assembly of FIG. 10 in accordance with an illustrative embodiment.
Figure 16:
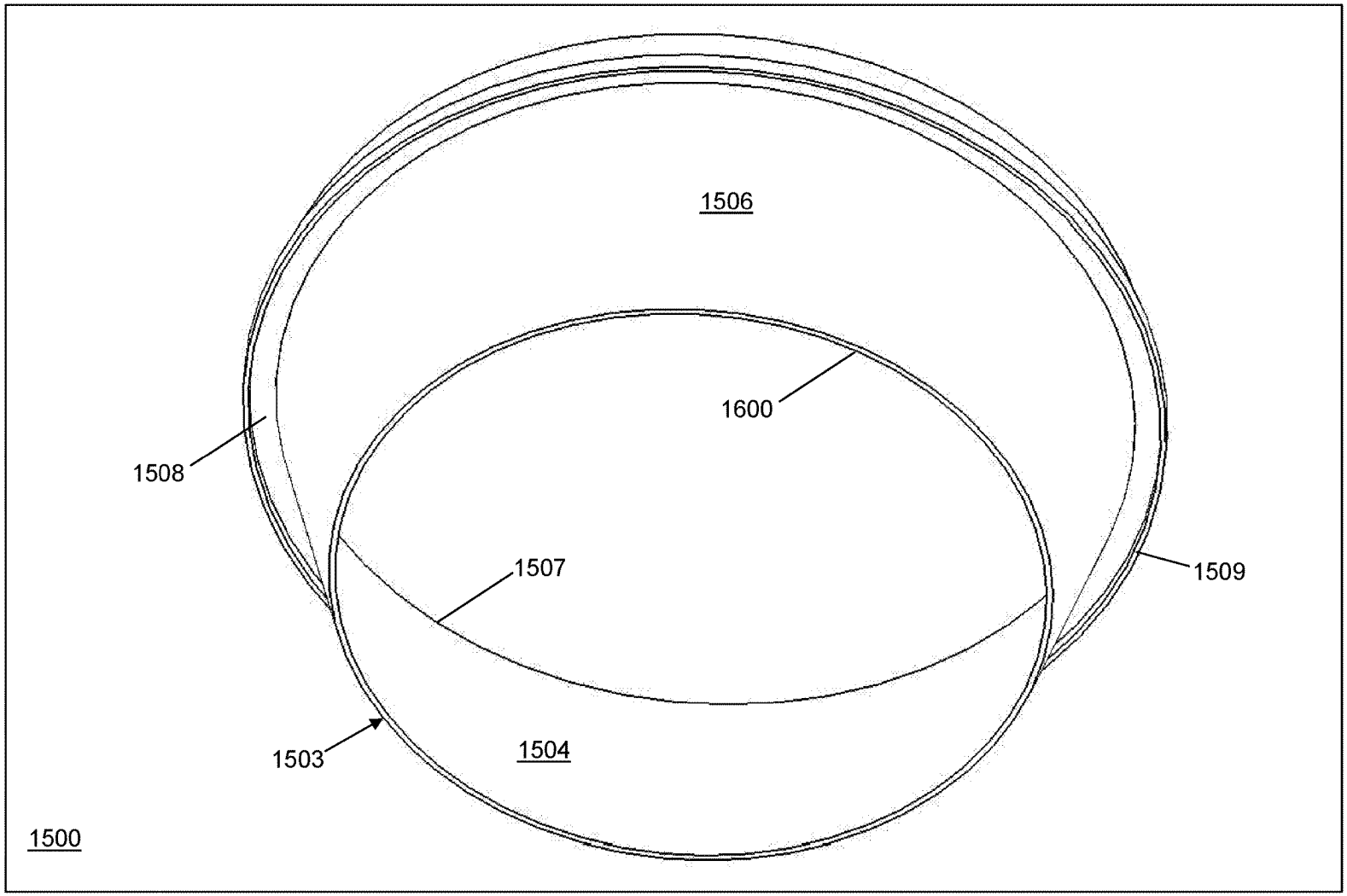
FIG. 16 depicts a bottom perspective view of an inner cone of the cone assembly of FIG. 15 in accordance with an illustrative embodiment.
Figure 17:
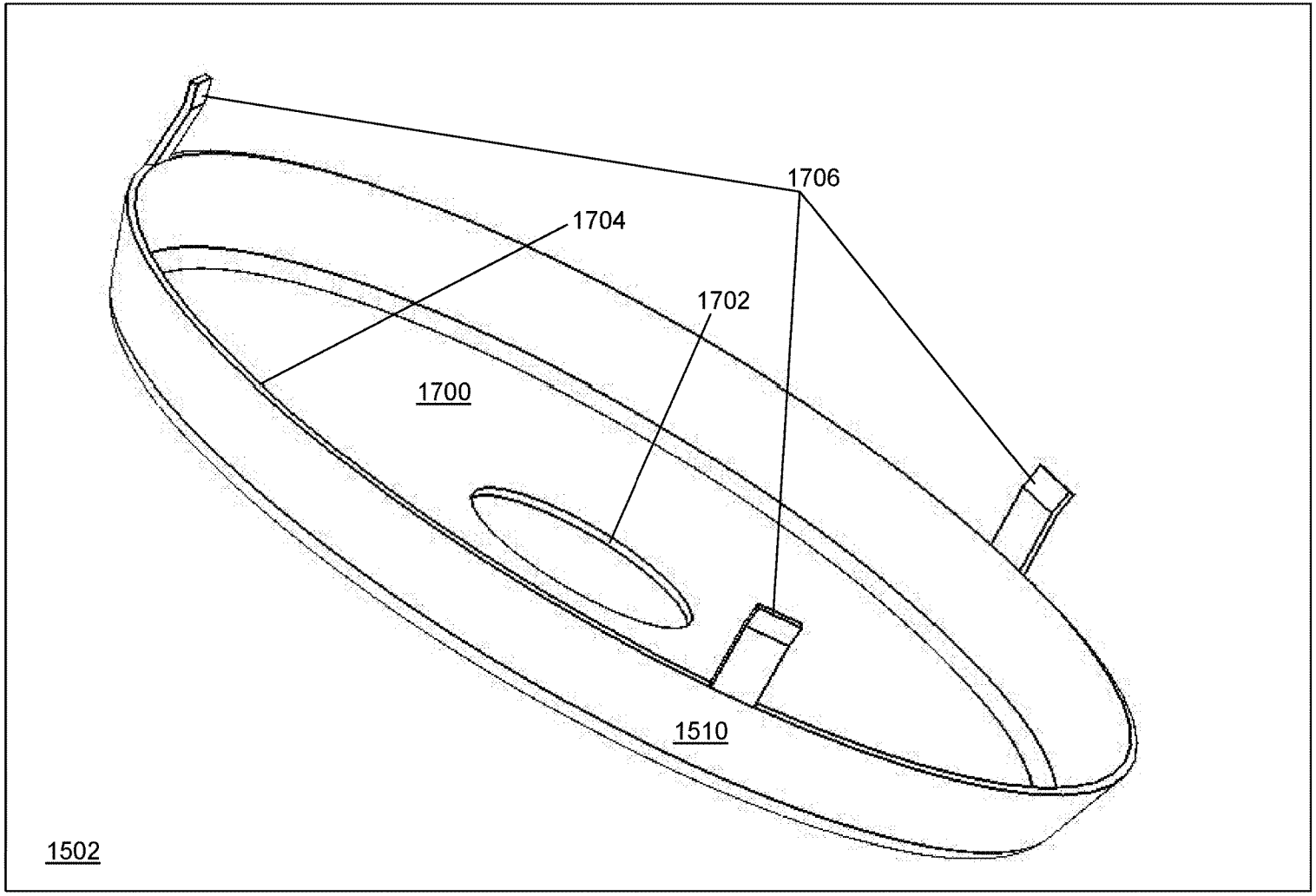
FIG. 17 depicts a side perspective view of a crumb catch of the cone assembly of FIG. 15 in accordance with an illustrative embodiment.

Referring to FIG. 15, a side perspective view of cone assembly 1016 is shown in accordance with an illustrative embodiment. Cone assembly 1016 may include an inner cone 1500 and a crumb catch 1502. Referring to FIG. 16, a bottom perspective view of inner cone 1500 is shown in accordance with an illustrative embodiment. Referring to FIG. 17, a side perspective view of crumb catch 1502 is shown in accordance with an illustrative embodiment. Cone assembly 1016 may be formed of various materials such as metal.

Inner cone 1500 may include a cone wall 1503 that forms a truncated cone that does not include a cone apex. Cone wall 1503 may include an inner surface 1504, an outer surface 1506, a top circumferential edge 1507, and a bottom circumferential edge 1600. In the illustrative embodiment, the truncated cone is a truncated right circular cone. A length of bottom circumferential edge 1600 is smaller than a length of top circumferential edge 1507 so that the truncated cone opens upward. In the illustrative embodiment of FIG. 16, bottom circumferential edge 1600 is open. In the illustrative embodiment, a cross-section of cone wall 1503 is generally circular though cone wall 1503 may have other cross-sectional shapes in other embodiments. For example, a cross-section of cone wall 1503 may form a polygon, an ellipse, etc.

Inner cone 1500 may further include a support flange 1508 and a rim wall 1509. Support flange 1508 extends from outer surface 1506 of cone wall 1503. Support flange 1508 is positioned near top circumferential edge 1507. Rim wall 1509 extends downward from an edge of support flange 1508 opposite outer surface 1506.

Crumb catch 1502 may include a bottom wall 1700, a side wall 1510, a burner aperture wall 1702, a circumferential edge 1704, and a plurality of support arms 1706. Bottom wall 1700 extends between bottom circumferential edge 1600 to close inner cone 1500. In the illustrative embodiments, bottom wall 1700 is generally circular though bottom wall 1700 may have other shapes in other embodiments. For example, bottom wall 1700 may form a polygon, an ellipse, etc.

Burner aperture wall 1702 is formed through bottom wall 1700. In the illustrative embodiment, burner aperture wall 1702 is generally circular though burner aperture wall 1702 may form other shapes in other embodiments. For example, burner aperture wall 1702 may form a polygon, an ellipse, etc. Burner aperture wall 1702 is sized and shaped to accommodate at least a portion of wok burner 140. Wok burner 140 is mounted to extend vertically up through burner aperture wall 1702.

Side wall 1510 extends upward from an edge of bottom wall 1700. A fourth chamfered edge may be formed as a transition between bottom wall 1700 and side wall 1510. Circumferential edge 1704 is an edge of side wall 1510 opposite bottom wall 1700. Bottom circumferential edge 1600 has a smaller circumference than bottom wall 1700 and circumferential edge 1704 so that at least a portion of cone wall 1503 fits within side wall 1510. In the illustrative embodiments, circumferential edge 1704 is generally circular though circumferential edge 1704 may form other shapes in other embodiments. For example, circumferential edge 1704 may form a polygon, an ellipse, etc. Side wall 1510 and cone wall 1503 may have the same or different slopes.

Burner aperture wall 1702 is sized and shaped to accommodate at least a portion of wok burner 140. Wok burner 140 is mounted to extend vertically up through burner aperture wall 1702.

The plurality of support arms 1706 extend upward from circumferential edge 1704 of side wall 1510. Outer surface 1506 of cone wall 1503 abuts the plurality of support arms 1706 when cone wall 1503 is positioned at least partially within side wall 1510.

Figure 24:
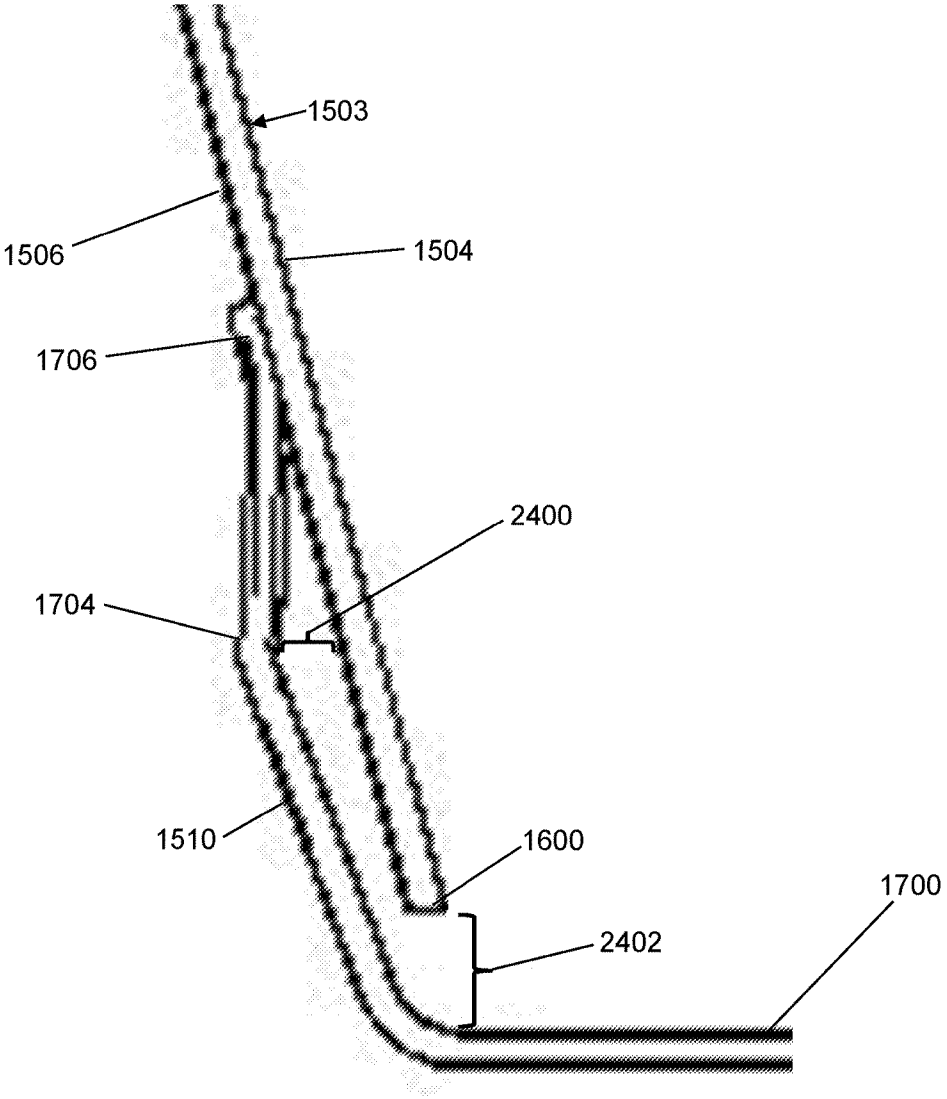
FIG. 24 depicts a zoomed view of a portion of the cone assembly of FIG. 15 in accordance with an illustrative embodiment.

Referring to FIG. 24, a zoomed view of a portion of cone assembly 1016 is shown in accordance with an illustrative embodiment. A distance between outer surface 1506 and circumferential edge 1704 of side wall 1510 defines a flue opening width 2400. The plurality of support arms 1706 may support bottom circumferential edge 1600 of cone wall 1503 above bottom wall 1700 a height 2402. For illustration, flue opening width 2400 and height 2402 may be from ~zero to ~50 mm.

Figure 26:
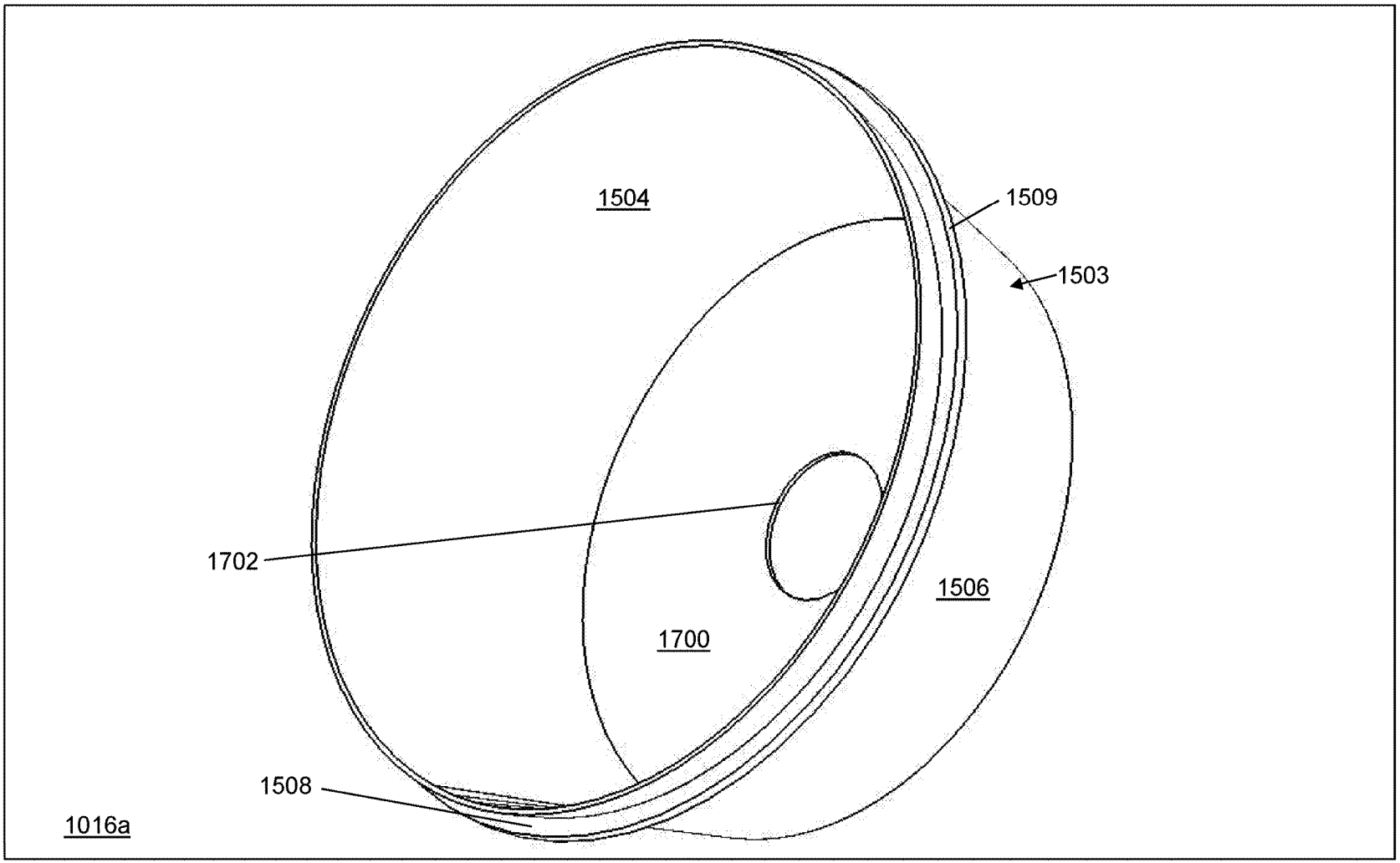
FIG. 26 depicts a top perspective view of a second cone assembly of the wok burner assembly in accordance with an illustrative embodiment.

Referring to FIG. 26, a top perspective view of a second cone assembly **1016*a* of wok assembly 122 is shown in accordance with an illustrative embodiment. Second cone assembly 1016*a* may include inner cone 1500 modified such that bottom wall 1700 is mounted directly to bottom circumferential edge 1600 of cone wall 1503 so that bottom circumferential edge 1600 is not open. Second cone assembly 1016*a* does not include side wall 1510, circumferential edge 1704, or the plurality of support arms 1706 of crumb catch 1502**.

Figure 18:
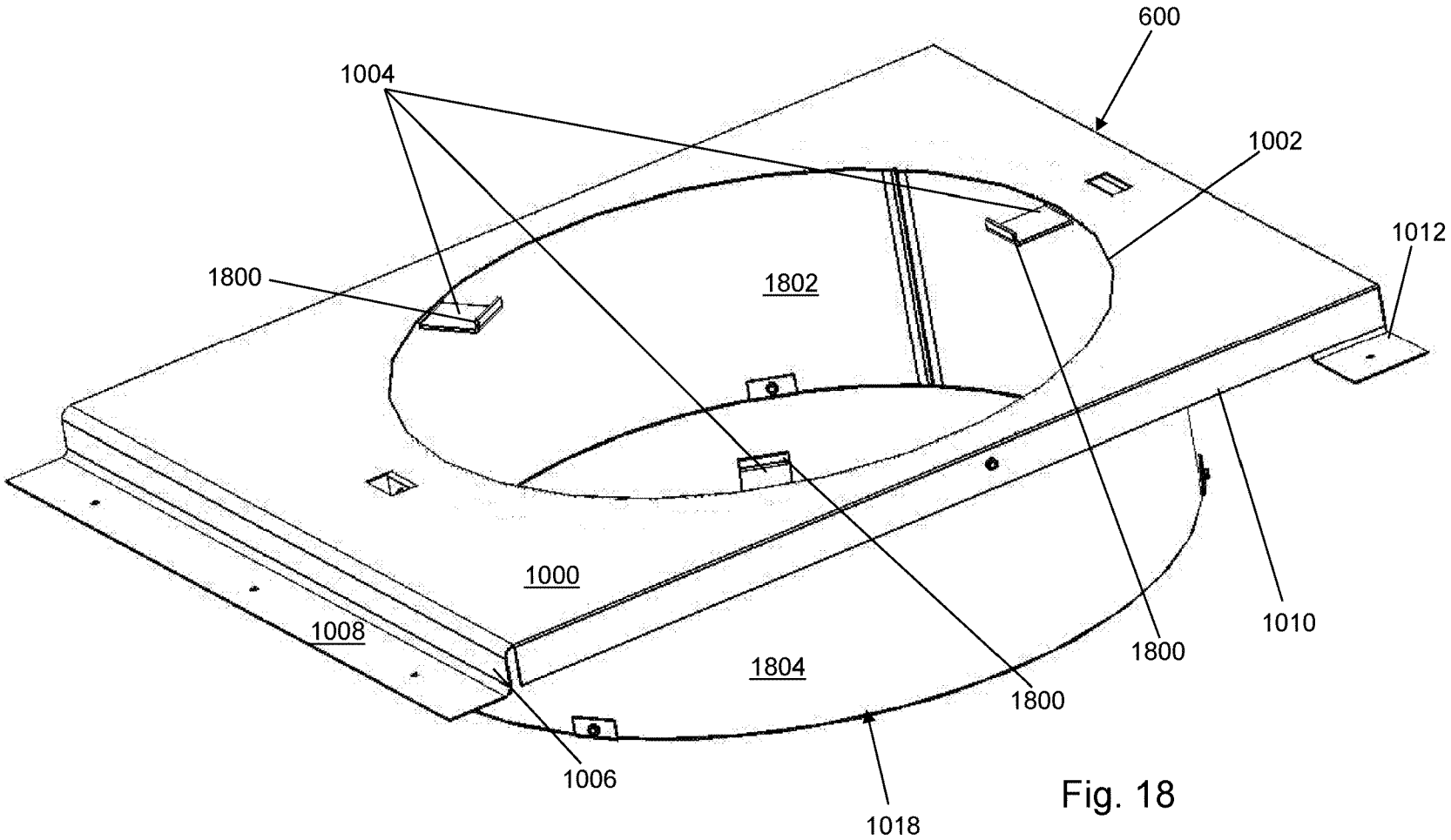
FIG. 18 depicts a back, top perspective view of a chimney of the chimney assembly and the support platform of the wok burner assembly of FIG. 4 in accordance with an illustrative embodiment.
Figure 19:
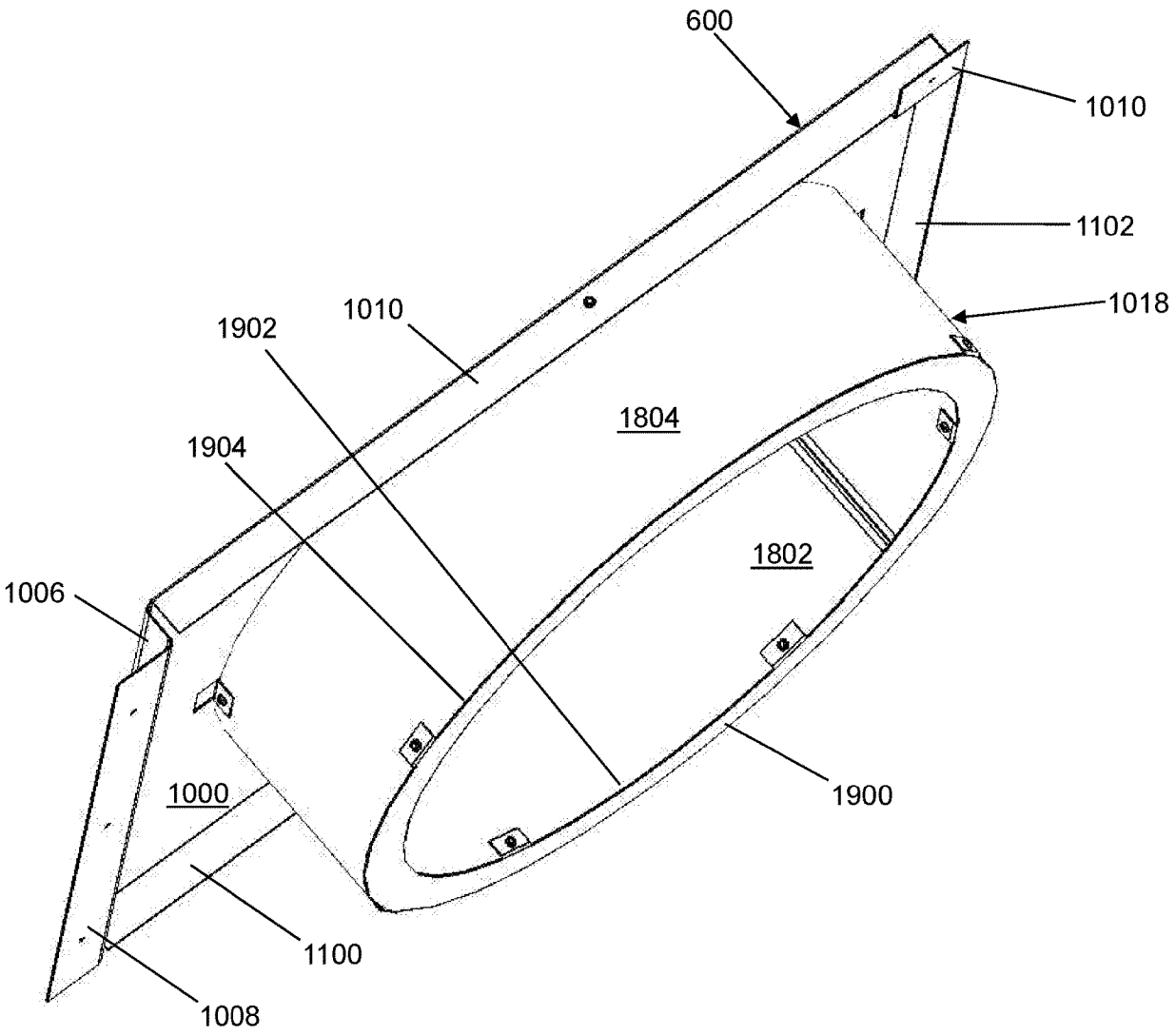
FIG. 19 depicts a back, bottom perspective view of the chimney and the support platform of FIG. 18 in accordance with an illustrative embodiment.
Figure 20:
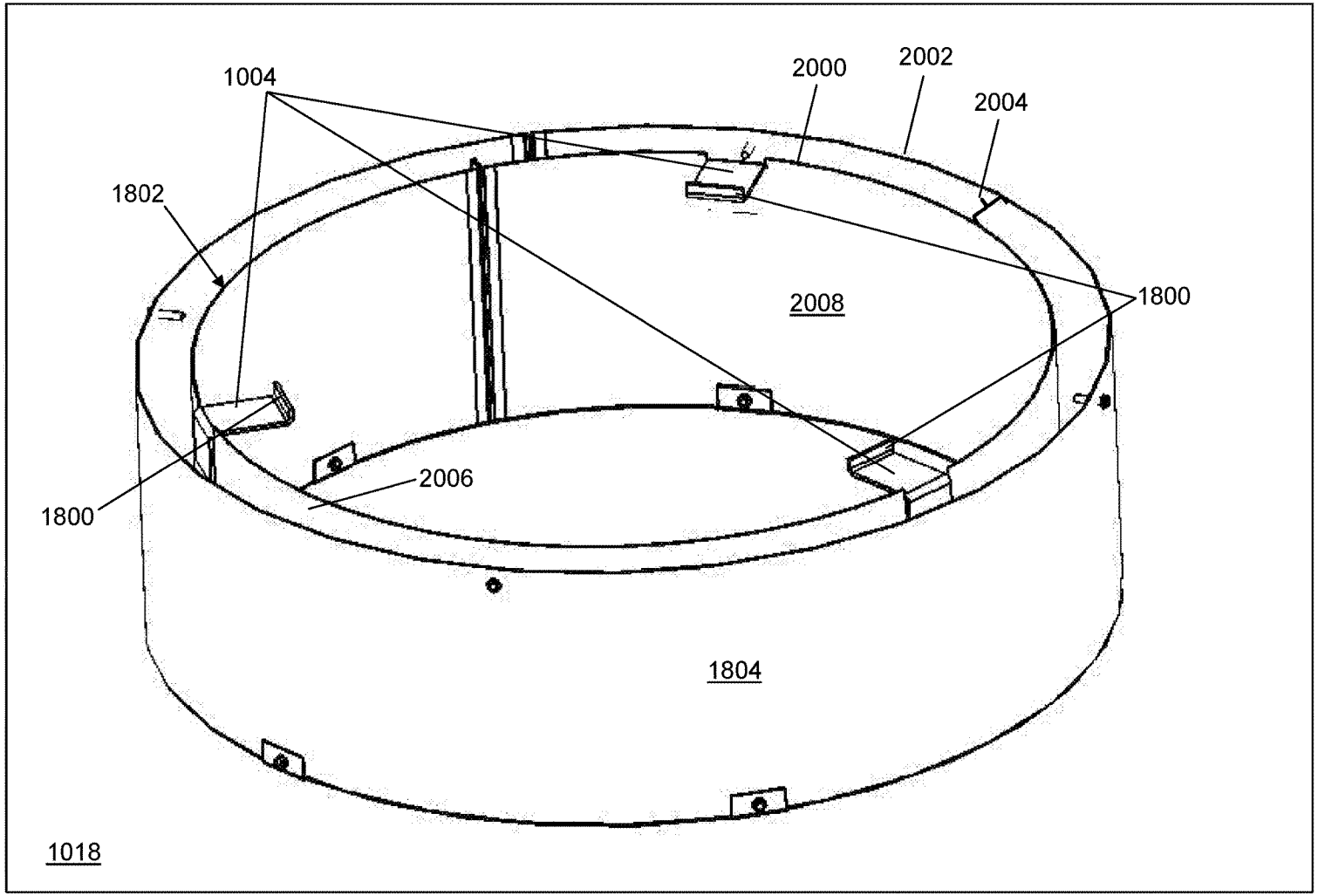
FIG. 20 depicts a side perspective view of the chimney of FIG. 18 in accordance with an illustrative embodiment.

Referring to FIG. 18, a back, top perspective view of chimney 1018 and support platform 600 is shown in accordance with an illustrative embodiment. Referring to FIG. 19, a back, bottom perspective view of chimney 1018 and support platform 600 is shown in accordance with an illustrative embodiment. Referring to FIG. 20, a side perspective view of chimney 1018 is shown in accordance with an illustrative embodiment. Chimney 1018 may include an inner wall 1802, an outer wall 1804, a bottom wall 1900 (shown referring to FIG. 19), and the plurality of tabs 1004.

Inner wall 1802 forms a first cylinder that has a first circumferential edge 2000 and a second circumferential edge 1902. First circumferential edge 2000 generally aligns with flue aperture wall 1002. Outer wall 1804 forms a second cylinder that has a third circumferential edge 2002 and a fourth circumferential edge 1904. Outer wall 1804 circumscribes inner wall 1802. Inner wall 1802 and outer wall 1804 are separated by an air gap having a chimney walls separation width 2004. For illustration, chimney walls separation width 2004 may be from ~2 to ~100 mm. The space between inner wall 1802 and outer wall 1804 may contain insulation or may be an air gap. Chimney 1018 acts as an insulator for cone assembly 1016.

Bottom chimney wall 1900 extends between second circumferential edge 1902 and fourth circumferential edge 1904. For illustration, various types of fasteners may be used to mount inner wall 1802 and outer wall 1804 to bottom chimney wall 1900. In the illustrative embodiment, inner wall 1802, outer wall 1804, and bottom chimney wall 1900 form a circle though inner wall 1802, outer wall 1804, and bottom chimney wall 1900 may form other shapes in other embodiments. For example, inner wall 1802, outer wall 1804, and bottom chimney wall 1900 may form a polygon, an ellipse, etc.

The plurality of tabs 1004 extend from first circumferential edge 2000 toward a center of the first cylinder formed by inner wall 1802. In the illustrative embodiment, the plurality of tabs 1004 mount directly to an outer surface 2006 of inner wall 1802. In alternative embodiments, the plurality of tabs 1004 may mount to outer wall 1804, to an inner surface 2008 of inner wall 1802, or may be integrally formed with inner wall 1802 or with outer wall 1804.

Each tab of the plurality of tabs 1004 may include a catch 1800 that extends upward from an edge of a respective tab of the plurality of tabs 1004. The edge of the respective tab is opposite inner wall 1802. Rim wall 1509 is positioned to abut catch 1800 of each tab of the plurality of tabs 1004 when cone assembly 1016 is mounted within inner wall 1802 of chimney 1018. Support flange 1508 rests on the plurality of tabs 1004 when cone assembly 1016 is mounted within inner wall 1802 of chimney 1018. Inner cone 1500 may be removed from crumb catch 1502 to facilitate cleaning of inner cone 1500 and of crumb catch 1502.

Referring to FIG. 21, a side perspective view of wok burner 140 is shown in accordance with an illustrative embodiment. Gas line 2100 extends from a bottom of wok burner 140 to connect to a valve controlled by the knob associated with control of wok burner 140.

Referring to FIG. 22, a right side perspective view of a Y-Z cross-section of wok assembly 122 is shown in accordance with an illustrative embodiment. Referring to FIG. 23, a right side view of the Y-Z cross-section of FIG. 22 is shown in accordance with an illustrative embodiment. Referring to FIG. 25, a front view of an X-Z cross-section of wok assembly 122 is shown in accordance with an illustrative embodiment.

A vent opening height 2300 separates top support wall 1000 of support platform 600 from top wall 400 of top plate 134. Vent opening height 2300 provided by the walls of outer support frame 136 aligns a top surface of top wall 400 with first grate 114 and/or second grate 124.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A chimney assembly of a wok burner assembly for a gas cooktop, the chimney assembly comprising:

a cone assembly comprising a wall that forms a truncated cone, wherein the wall has an inner surface, an outer surface, a first circumferential edge, and a second circumferential edge, and the truncated cone does not include a cone apex;

a support flange that extends from the outer surface of the wall; and a bottom wall that extends between the second circumferential edge of the wall, wherein the bottom wall includes a burner aperture wall formed through the bottom wall and a length of the second circumferential edge is smaller than a length of the first circumferential edge; and a chimney comprising an inner wall that forms a first cylinder, wherein the inner wall has a third circumferential edge and a fourth circumferential edge;

an outer wall that forms a second cylinder, wherein the outer wall has a fifth circumferential edge and a sixth circumferential edge, wherein the outer wall circumscribes the inner wall, and the inner wall and the outer wall are separated by an air gap;

a bottom chimney wall that extends between the third circumferential edge and the fifth circumferential edge; and a plurality of tabs that extend from the fourth circumferential edge toward a center of the first cylinder, wherein the support flange rests on the plurality of tabs when the cone assembly is mounted within the inner wall of the chimney.

2. The chimney assembly of claim 1, wherein the plurality of tabs are configured to support the cone assembly.

3. The chimney assembly of claim 1, wherein the plurality of tabs are equally distributed around the fourth circumferential edge of the inner wall.

4. The chimney assembly of claim 3, wherein a number of the plurality of tabs ranges from two tabs to twelve tabs.

5. The chimney assembly of claim 1, wherein the plurality of tabs are mounted to the inner wall of the chimney.

6. The chimney assembly of claim 1, wherein a distance between the fourth circumferential edge of the inner wall and an edge of the support flange defines a chimney opening width.

7. The chimney assembly of claim 1, wherein a distance between the inner wall and the outer wall defines a chimney walls separation width.

8. The chimney assembly of claim 1, wherein the cone assembly further comprises a rim wall that extends downward from an edge of the support flange opposite the outer surface of the wall.

9. The chimney assembly of claim 8, wherein each tab of the plurality of tabs comprises a catch that extends upward from an edge of a respective tab of the plurality of tabs, wherein the edge of the respective tab is opposite the inner wall, wherein the rim wall is positioned to abut the catch of each tab of the plurality of tabs when the cone assembly is mounted within the inner wall of the chimney.

10. The chimney assembly of claim 1, wherein the truncated cone is a truncated right circular cone.

11. The chimney assembly of claim 1, wherein the bottom wall is mounted directly to the second circumferential edge of the wall.

12. The chimney assembly of claim 1, wherein the cone assembly further comprises a side wall that extends upward from the bottom wall, and the second circumferential edge of the wall defines a cone aperture edge that is open and has a smaller circumference than the bottom wall.

13. The chimney assembly of claim 12, wherein the cone assembly further comprises a plurality of support arms that extend upward from the side wall, wherein the outer surface of the wall abuts the plurality of support arms when the wall is positioned at least partially within the side wall.

14. The chimney assembly of claim 13, wherein a distance between the outer surface of the wall and the side wall defines a flue opening width.

15. A wok burner assembly for a gas cooktop, the wok burner assembly comprising:

a chimney assembly comprising a cone assembly comprising a wall that forms a truncated cone, wherein the wall has an inner surface, an outer surface, a first circumferential edge, and a second circumferential edge, and the truncated cone does not include a cone apex;

a support flange that extends from the outer surface of the wall; and a bottom wall that extends between the second circumferential edge of the wall, wherein the bottom wall includes a burner aperture wall formed through the bottom wall and a length of the second circumferential edge is smaller than a length of the first circumferential edge; and a chimney comprising an inner wall that forms a first cylinder, wherein the inner wall has a third circumferential edge and a fourth circumferential edge;

an outer wall that forms a second cylinder, wherein the outer wall has a fifth circumferential edge and a sixth circumferential edge, wherein the outer wall circumscribes the inner wall, and the inner wall and the outer wall are separated by an air gap;

a bottom chimney wall that extends between the third circumferential edge of the inner wall and the fifth circumferential edge of the outer wall; and a plurality of tabs that extend from the fourth circumferential edge of the inner wall toward a center of the first cylinder, wherein the support flange rests on the plurality of tabs when the cone assembly is mounted within the inner wall of the chimney;

a wok burner mounted through the burner aperture wall;

an outer support frame;

a top plate comprising a ring aperture wall formed through the top plate, wherein the top plate is mounted on the outer support frame, which supports the top plate above the fourth circumferential edge of the inner wall; and a wok ring positioned adjacent the first circumferential edge of the wall within the ring aperture wall.

16. The wok burner assembly of claim 15, further comprising a vent frame that includes a plurality of walls that surround the chimney, wherein the plurality of walls each include a plurality of apertures.

17. The wok burner assembly of claim 15, further comprising a support platform comprising a top support wall comprising a flue aperture wall formed through the top support wall, wherein the top support wall rests on the fourth circumferential edge of the inner wall.

18. The wok burner assembly of claim 17, wherein a distance between a top surface of the top support wall and a lower surface of the top plate defines a vent opening width.

19. The wok burner assembly of claim 15, wherein the wok burner is rated to provide greater than approximately 22,000 British thermal units.

20. A gas cooktop comprising:

a housing comprising one or more walls;

an input gas line;

a chimney assembly comprising a cone assembly comprising a wall that forms a truncated cone, wherein the wall has an inner surface, an outer surface, a first circumferential edge, and a second circumferential edge, and the truncated cone does not include a cone apex;

a support flange that extends from the outer surface of the wall; and a bottom wall that extends between the second circumferential edge of the wall, wherein the bottom wall includes a burner aperture wall formed through the bottom wall and a length of the second circumferential edge is smaller than a length of the first circumferential edge; and a chimney comprising an inner wall that forms a first cylinder, wherein the inner wall has a third circumferential edge and a fourth circumferential edge;

an outer wall that forms a second cylinder, wherein the outer wall has a fifth circumferential edge and a sixth circumferential edge, wherein the outer wall circumscribes the inner wall, and the inner wall and the outer wall are separated by an air gap;

a bottom chimney wall that extends between the third circumferential edge of the inner wall and the fifth circumferential edge of the outer wall; and a plurality of tabs that extend from the fourth circumferential edge of the inner wall toward a center of the first cylinder, wherein the support flange rests on the plurality of tabs when the cone assembly is mounted within the inner wall of the chimney;

a wok burner mounted through the burner aperture wall;

an outer support frame;

a top plate comprising a ring aperture wall formed through the top plate, wherein the top plate is mounted on the outer support frame, which supports the top plate above the fourth circumferential edge of the inner wall;

a wok ring positioned adjacent the first circumferential edge of the wall within the ring aperture wall; and a knob assembly comprising a valve configured to connect to the input gas line to receive gas; and a knob mounted to the valve to control a flow of the received gas from the valve to the wok burner when the knob is rotated.

* * * * *